US011465414B2

(12) United States Patent
Ishii

(10) Patent No.: US 11,465,414 B2
(45) Date of Patent: Oct. 11, 2022

(54) LIQUID EJECTING APPARATUS

(71) Applicant: SEIKO EPSON CORPORATION, Tokyo (JP)

(72) Inventor: Hiroyuki Ishii, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 61 days.

(21) Appl. No.: 17/170,152

(22) Filed: Feb. 8, 2021

(65) Prior Publication Data

US 2021/0245503 A1 Aug. 12, 2021

(30) Foreign Application Priority Data

Feb. 10, 2020 (JP) ..... JP2020-020367

(51) Int. Cl.
*B41J 2/175* (2006.01)
*B41J 2/14* (2006.01)
*B41J 2/155* (2006.01)

(52) U.S. Cl.
CPC ..... *B41J 2/14* (2013.01); *B41J 2/155* (2013.01); *B41J 2002/14419* (2013.01)

(58) Field of Classification Search
CPC . B41J 2/14; B41J 2/155; B41J 2/17509; B41J 2/1752
See application file for complete search history.

(56) References Cited

U.S. PATENT DOCUMENTS 6,036,304 A * 3/2000 Emanuel ..... B41J 2/175 347/86
2003/0227522 A1* 12/2003 Pan ..... B41J 2/17523 347/85
2005/0024449 A1 2/2005 Shiho et al.
2005/0110272 A1 5/2005 Takagi
2007/0139463 A1 6/2007 Chikamoto et al.
2013/0293627 A1 11/2013 Ishii et al.
2013/0293635 A1* 11/2013 Owaki ..... B41J 2/155 347/40

FOREIGN PATENT DOCUMENTS

| | | |
|---|---|---|
| JP | 2004-330709 | 11/2004 |
| JP | 2005-067039 | 3/2005 |
| JP | 2005-106092 | 4/2005 |
| JP | 2007-160823 | 6/2007 |
| JP | 2013-248876 | 12/2013 |
| JP | 2017-082906 | 5/2017 |

* cited by examiner

*Primary Examiner* — Jason S Uhlenhake
(74) *Attorney, Agent, or Firm* — Workman Nydegger

(57) ABSTRACT

A liquid ejecting apparatus includes a first head having a first channel pipe, a channel member having a second channel pipe, and a first tube that communicates the first channel pipe with the second channel pipe and that has flexibility. The first tube has a first end portion and a second end portion that is opposite to the first end portion. The first tube is coupled to the first channel pipe in such a manner that the first end portion covers an outer periphery of the first channel pipe. The first tube is also coupled to the second channel pipe in such a manner that the second end portion covers an outer periphery of the second channel pipe. A fixation strength between the first tube and the first channel pipe is greater than a fixation strength between the first tube and the second channel pipe.

16 Claims, 18 Drawing Sheets

LIQUID EJECTING APPARATUS

The present application is based on, and claims priority from JP Application Serial Number 2020-020367, filed Feb. 10, 2020, the disclosure of which is hereby incorporated by reference herein in its entirety.

BACKGROUND

1. Technical Field

The present disclosure relates to a liquid ejecting apparatus, and in particular, to an ink jet type recording apparatus that ejects ink as a type of liquid.

2. Related Art

An ink jet type recording apparatus, such as an ink jet type printer or plotter, is a typical example of a liquid ejecting apparatus. A known liquid ejecting apparatus includes multiple liquid ejecting heads configured to eject a liquid, such as ink, supplied from an ink bus (equivalent to a channel member) and also includes a support member that supports the multiple liquid ejecting heads (for example, JP-A-2017-82906).

In the liquid ejecting apparatus, fluid channels are formed in each of the liquid ejecting heads and in the channel member, and the fluid channels open at respective connection ports. The connection port of each liquid ejecting head is coupled by a tube to the connection port of the channel member.

This known art, however, does not describe the relationship of a fixation strength between the tube and the liquid ejecting head to a fixation strength between the tube and the channel member. Assume that the fixation strength between the tube and the liquid ejecting head is equal to the fixation strength between the tube and the channel member.

In this case, when the liquid ejecting head is detached from the channel member for replacement, the tube may be detached from the liquid ejecting head and remain to be coupled to the channel member.

When it is necessary to replace the tube simultaneously with the replacement of the liquid ejecting head, some additional work is required to detach the tube from the channel member, which deteriorates replacement performance of the liquid ejecting head.

Note that this problem is not specific to the ink jet type recording apparatus alone. This problem also occurs in a liquid ejecting apparatus that ejects a liquid other than ink.

SUMMARY

In view of this background, the present disclosure provides a liquid ejecting apparatus that can improve performance in replacement of a liquid ejecting head.

According to an aspect of the present disclosure, a liquid ejecting apparatus includes a first liquid ejecting head that ejects a liquid in a first direction and has a first channel pipe that enables the liquid to flow therethrough, a channel member having a second channel pipe that enables the liquid to flow therethrough, and a flexible first tube that communicates the first channel pipe with the second channel pipe. The first tube has a first end portion and a second end portion that is opposite to the first end portion. The first tube is coupled to the first channel pipe in such a manner that the first end portion covers an outer periphery of the first channel pipe, and the first tube is coupled to the second channel pipe in such a manner that the second end portion covers an outer periphery of the second channel pipe. In addition, a fixation strength between the first tube and the first channel pipe is greater than a fixation strength between the first tube and the second channel pipe.

DESCRIPTION OF EXEMPLARY EMBODIMENT

Embodiment 1

Figure 1:
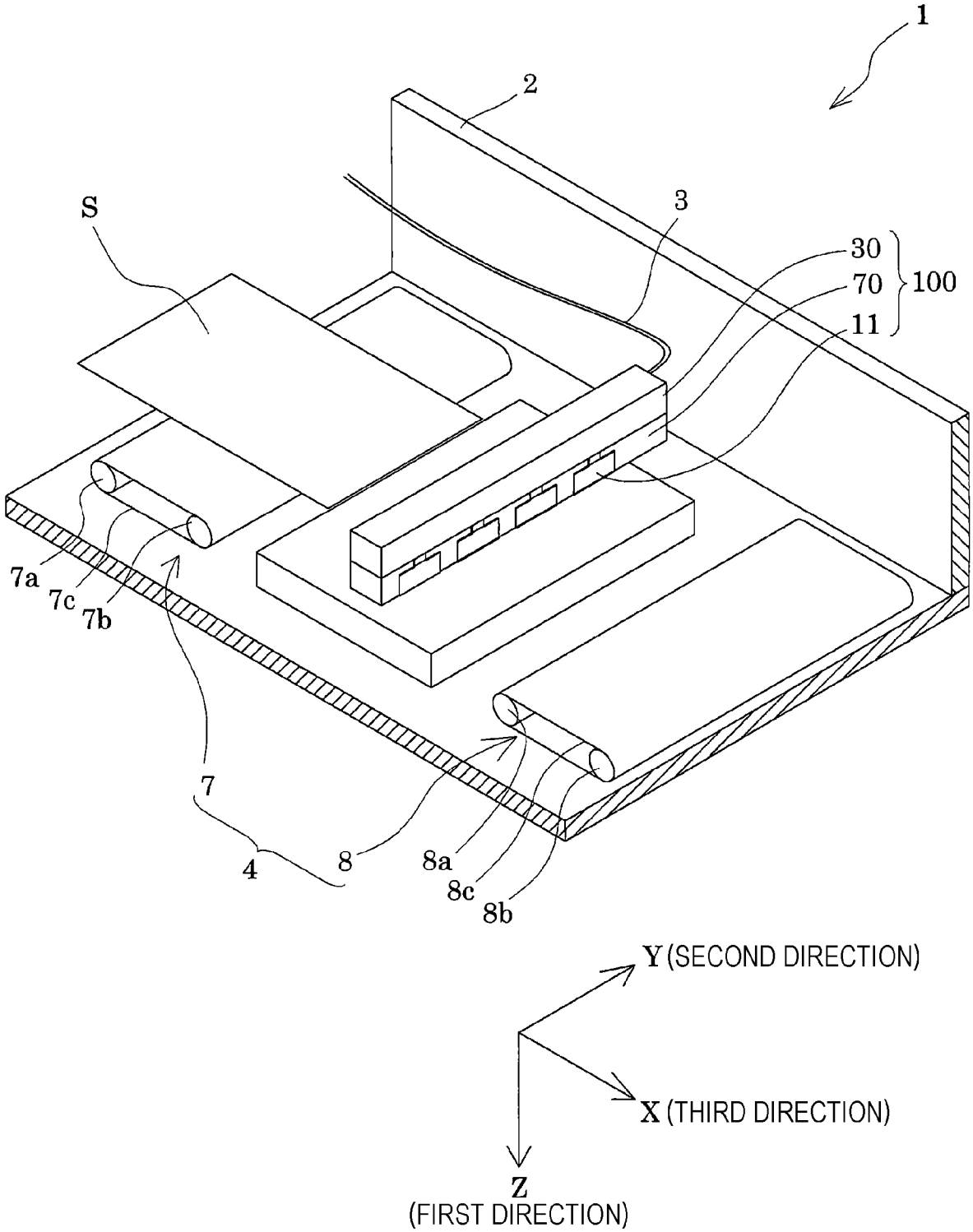
FIG. 1 is a perspective view illustrating an ink jet type recording apparatus according to Embodiment 1.
Figure 2:
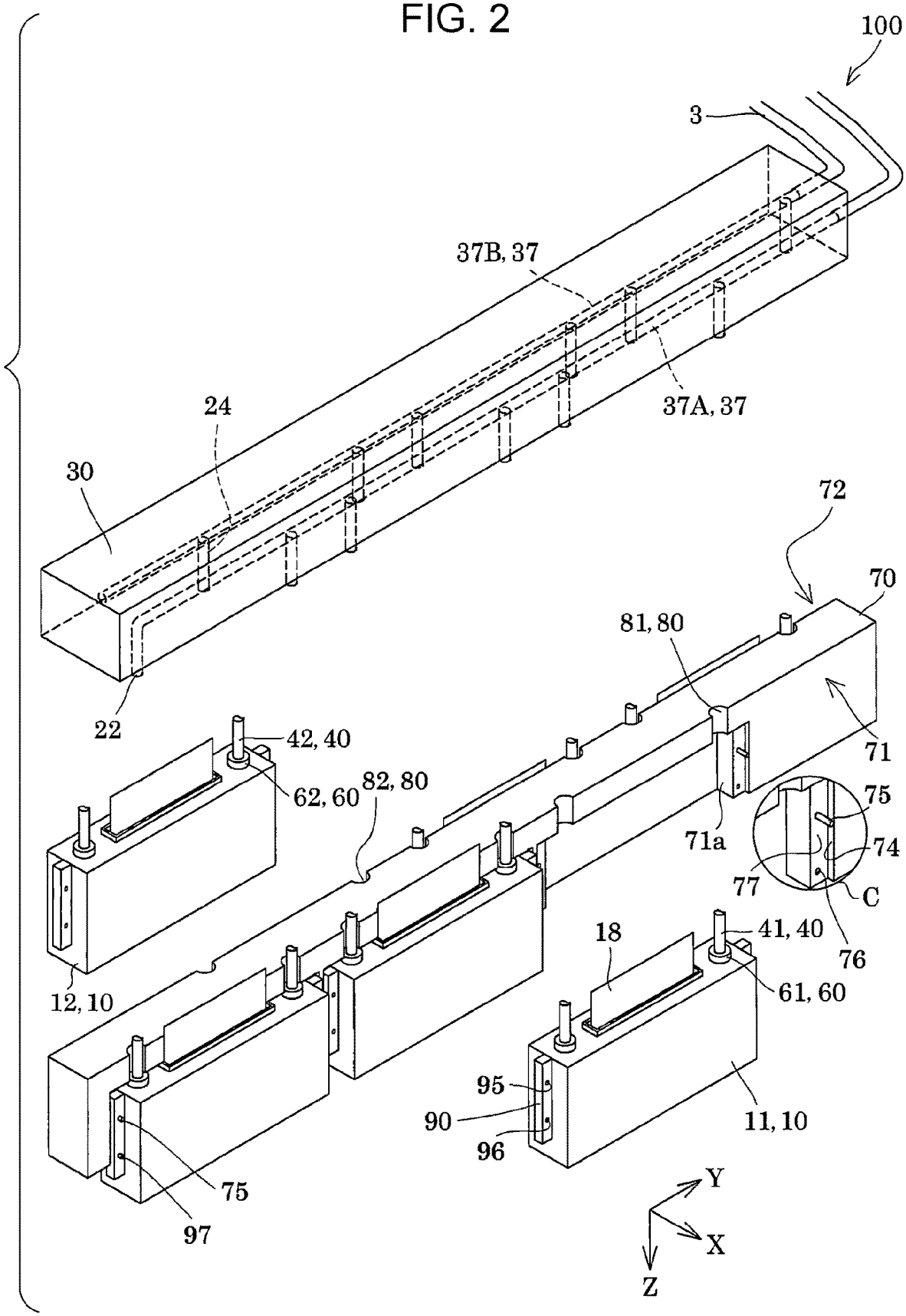
FIG. 2 is an exploded perspective view illustrating part of the ink jet type recording apparatus according to Embodiment 1.
Figure 3:
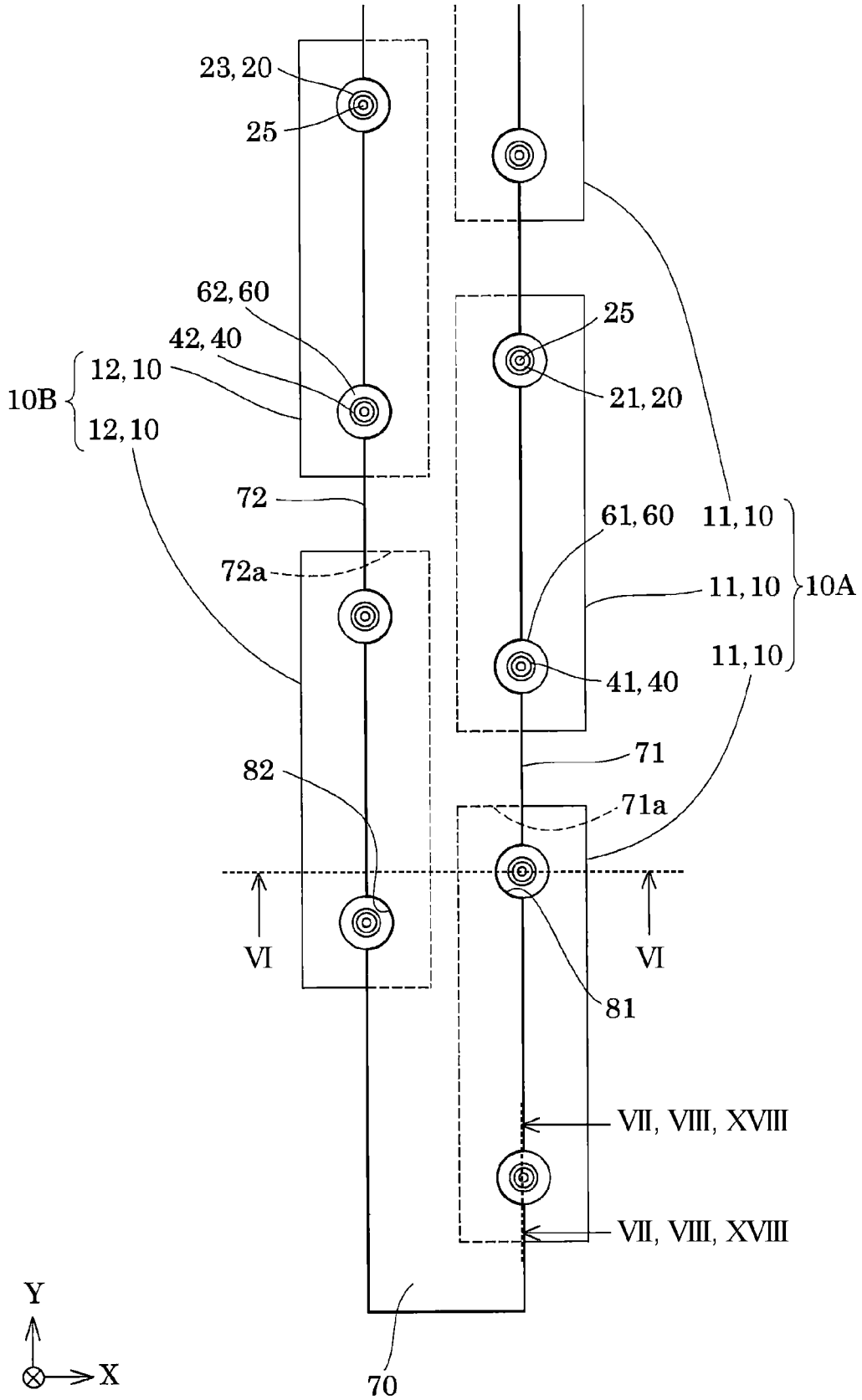
FIG. 3 is a plan view illustrating part of the ink jet type recording apparatus according to Embodiment 1.
Figure 4:
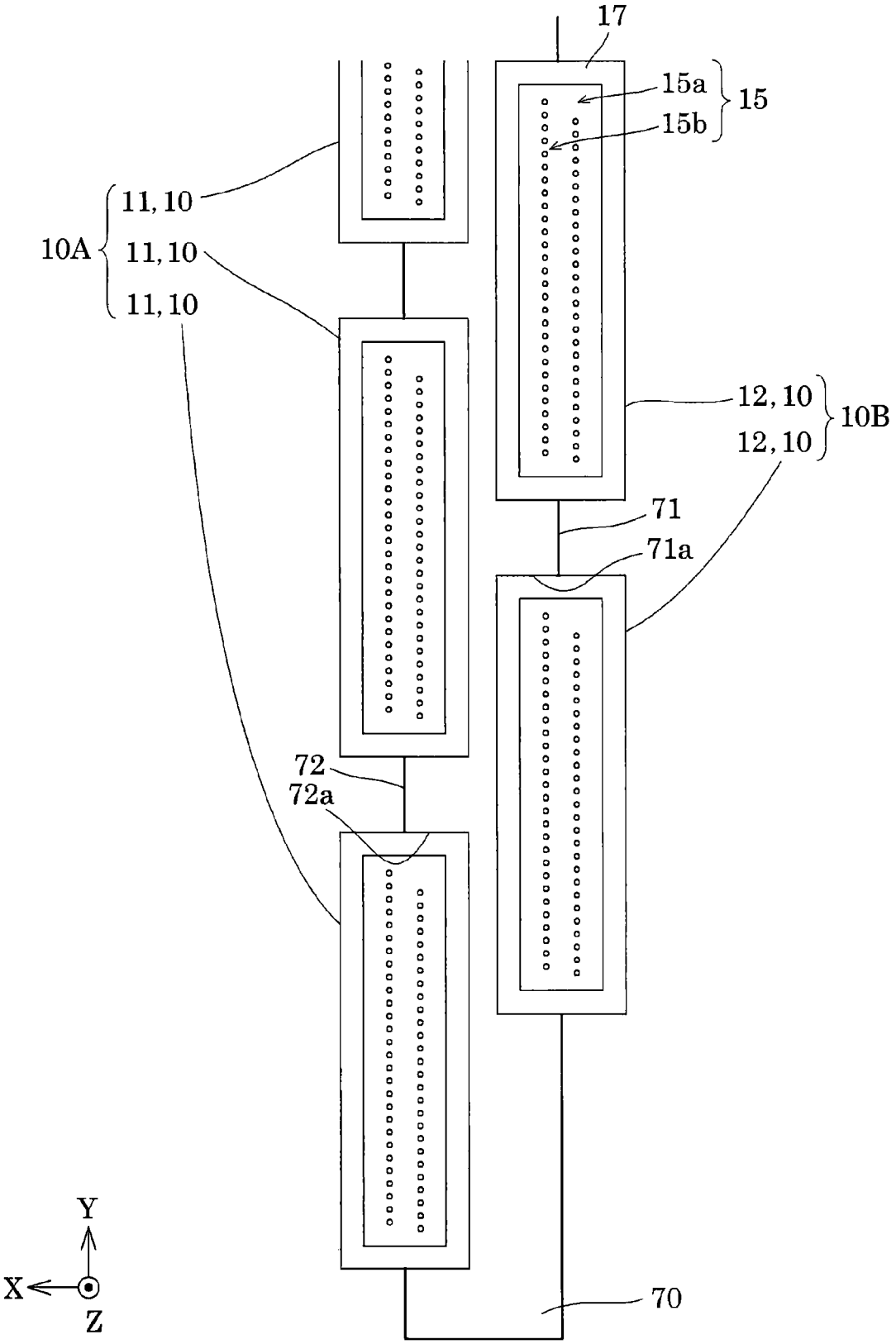
FIG. 4 is a bottom view illustrating part of the ink jet type recording apparatus according to Embodiment 1.
Figure 5:
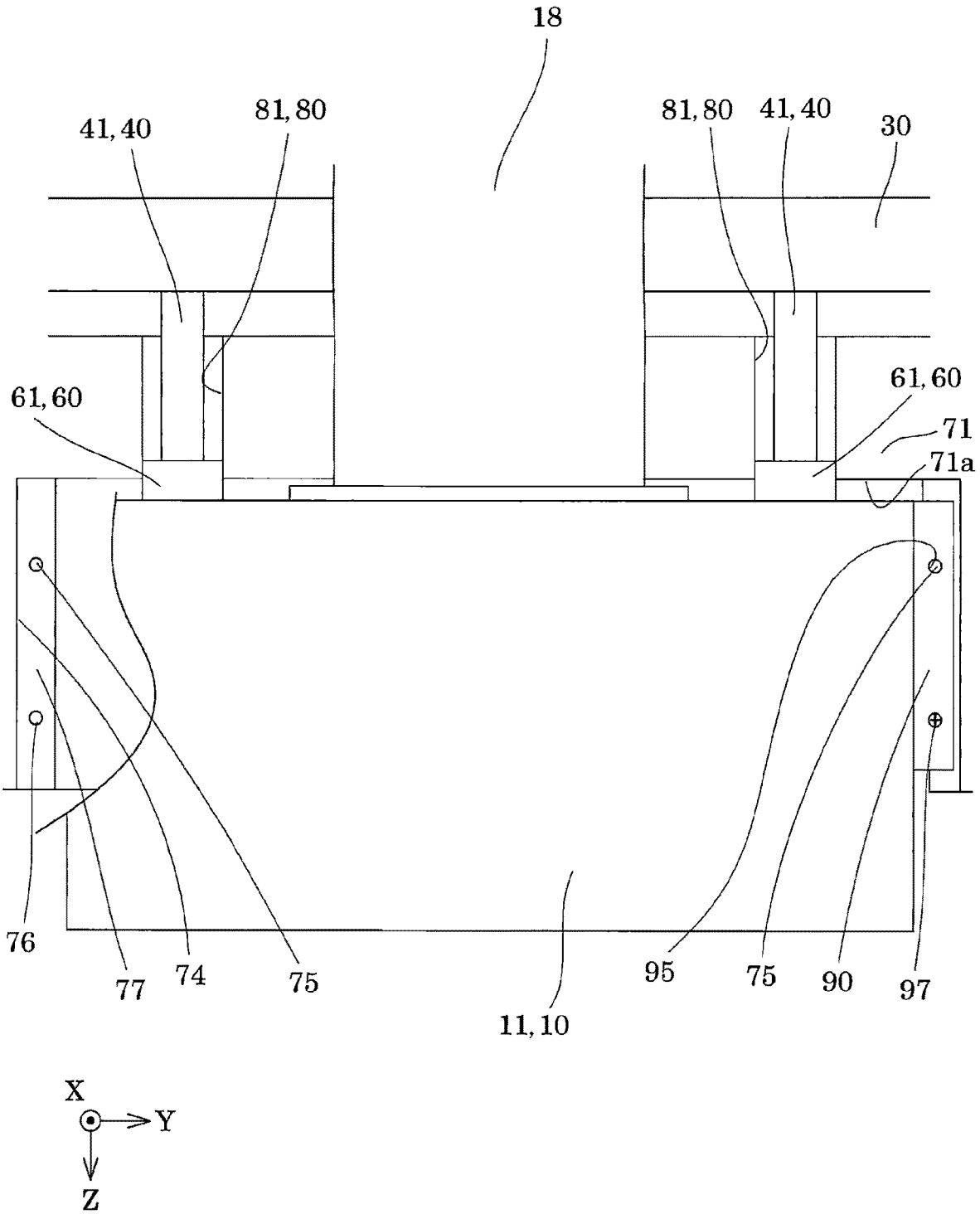
FIG. 5 is a side view illustrating part of the ink jet type recording apparatus according to Embodiment 1.
Figure 6:
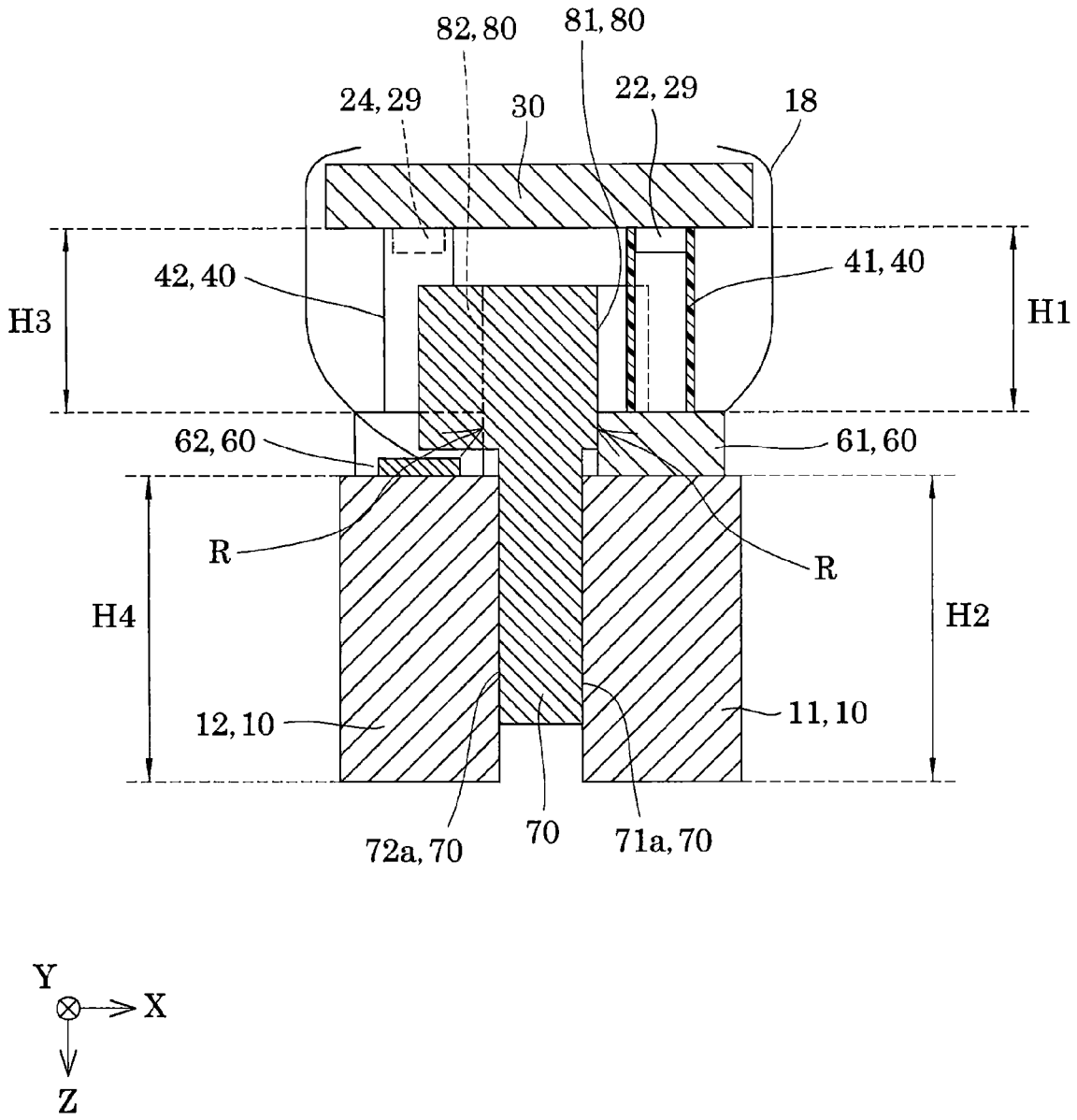
FIG. 6 is a cross section of the ink jet type recording apparatus taken along line VI-VI in FIG. 3.
Figure 7:
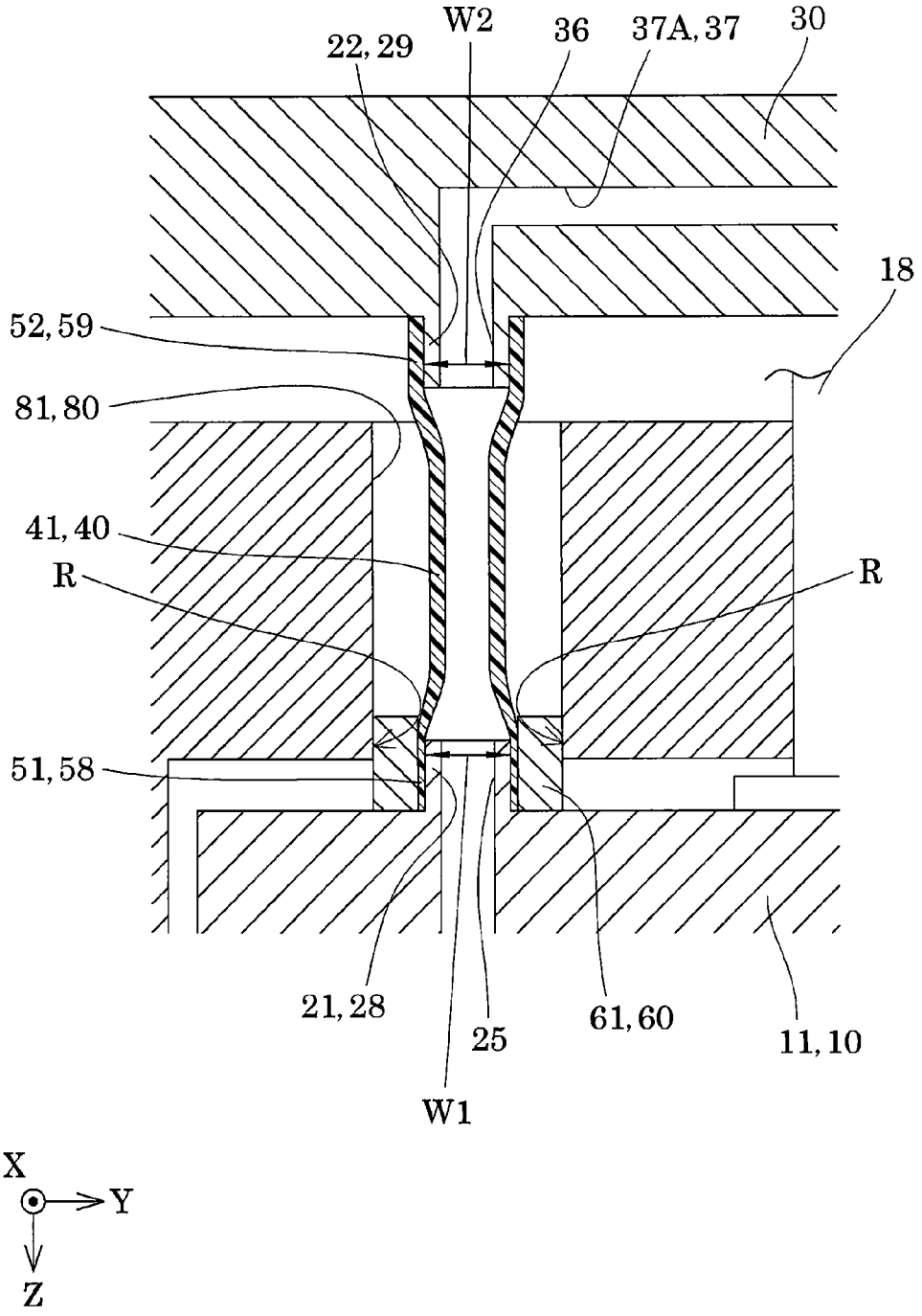
FIG. 7 is a cross section of the ink jet type recording apparatus taken along line VII-VII in FIG. 3.
Figure 8:
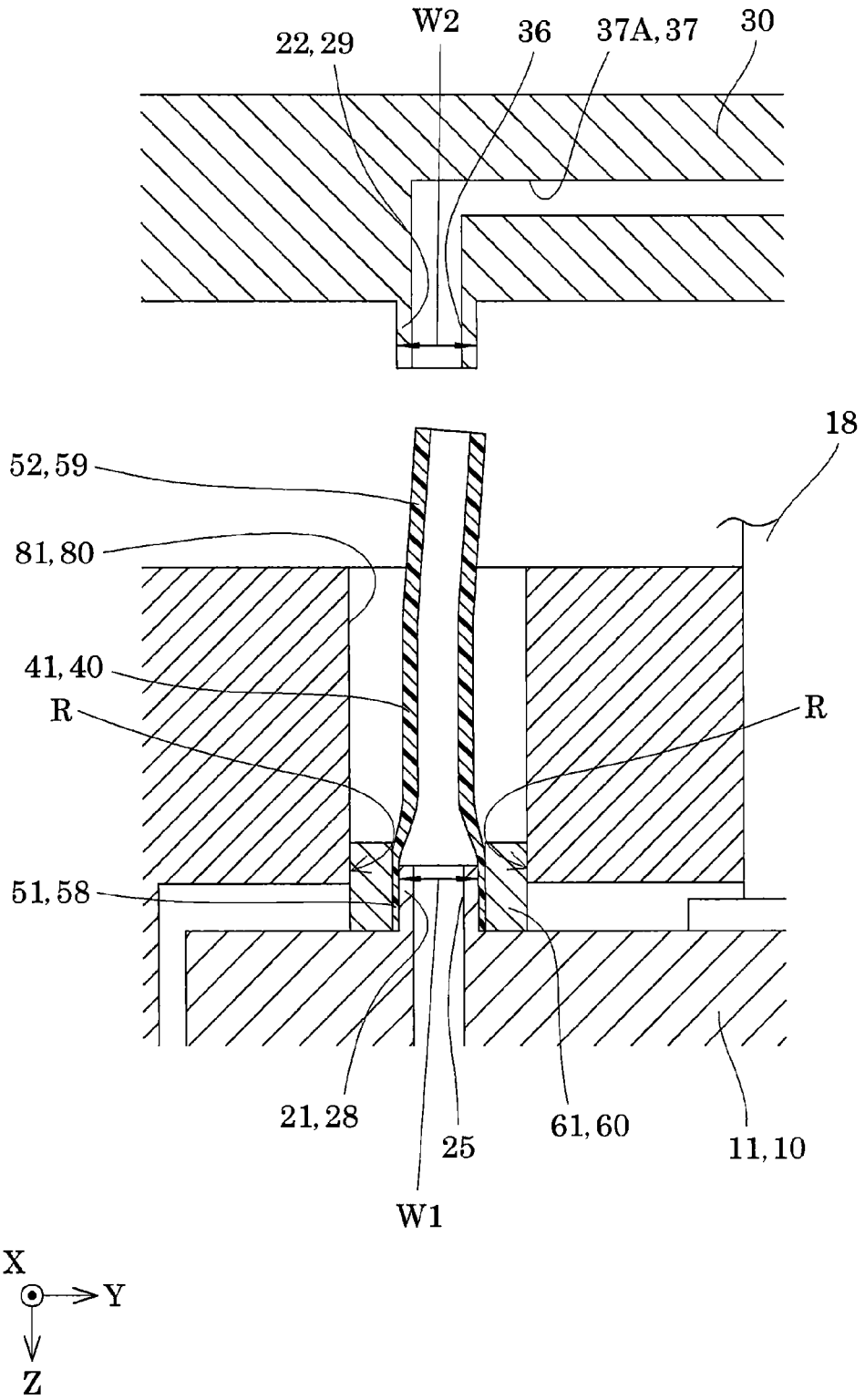
FIG. 8 is a cross section of the ink jet type recording apparatus taken along line VII-VII in FIG. 3, in which a first tube is detached from a channel member.

FIG. 1 is a perspective view illustrating an ink jet type recording apparatus according to the present embodiment, which is an example of a liquid ejecting apparatus. FIG. 2 is an exploded perspective view illustrating part of the ink jet type recording apparatus. FIG. 3 is a plan view illustrating part of the ink jet type recording apparatus. FIG. 4 is a bottom view illustrating part of the ink jet type recording apparatus. FIG. 5 is a side view illustrating part of the ink jet type recording apparatus. FIG. 6 is a cross section of the ink jet type recording apparatus taken along line VI-VI in FIG. 3. FIG. 7 is a cross section of the ink jet type recording apparatus taken along line VII-VII in FIG. 3. FIG. 8 is a cross section of the ink jet type recording apparatus taken along line VII-VII in FIG. 3, in which a first tube is detached from a channel member. In FIG. 2, Circle C is an enlarged view illustrating the vicinity of a mounting recess 74 of a support member 70, which will be described later. In FIG. 5, part of the head that faces in the −Y direction is omitted to expose the mounting recess 74.

In the present embodiment, a +Z direction in the drawings corresponds to a "first direction". In the drawings, a ±Y direction, which is perpendicular to the +X direction, corresponds to a "second direction". In the drawings, a ±X direction, which is perpendicular to the +Z direction and the +Y direction, corresponds to a "third direction". In the drawings, arrow X points in the +X direction, and the −X direction is a direction opposite to the +X direction. Arrow Y points in the +Y direction, and the −Y direction is a direction opposite to the +Y direction. Arrow Z points in the +Z direction, and the −Z direction is a direction opposite to the +Z direction. A ±X direction is meant to include any one of the +X direction and the −X direction. A ±Y direction is meant to include any one of the +Y direction and the −Y direction. A ±Z direction is meant to include any one of the +Z direction and the −Z direction.

FIG. 5 is a side view showing a first side surface 71 of the support member 70 (to be described later). This side view is similar to that showing a second side surface 72, which is a surface of the support member 70 opposite to the first side surface 71. Accordingly, the side view for the second side surface 72 is omitted. Similarly, FIG. 7 is a cross section of the support member 70 taken along the first side surface 71. This cross section is similar to that taken along the second side surface 72. Accordingly, the cross section for the second side surface 72 is omitted.

An ink jet type recording apparatus 1, which is an example of a liquid ejecting apparatus, is a so-called line printing type recording apparatus that performs printing onto a liquid receiving medium S, such as a recording sheet, while transporting the liquid receiving medium S. More specifically, the ink jet type recording apparatus 1 includes a head unit 100, an apparatus body 2, an ink tube 3, a transport unit 4 for transporting liquid receiving media S, and other components. The head unit 100 is an essential part of the ink jet type recording apparatus 1 of the present embodiment. The head unit 100 has ink jet type recording heads 10, a channel member 30, tubes 40, fixation members 60, a support member 70, and guide grooves 80, which will be described in detail later. The ink jet type recording head 10 is an example of a liquid ejecting head. The ink jet type recording head 10 is also referred to simply as the "head 10".

The ink jet type recording apparatus 1 includes multiple heads 10. In the present embodiment, the ink jet type recording apparatus 1 includes a head row 10A and a head row 10B. In the head row 10A, three first heads 11 are disposed side by side in the ±Y direction. The first head 11 is an example of a "first liquid ejecting head". In the head row 10B, three second heads 12 are disposed side by side in the ±Y direction. The second head 12 is an example of a "second liquid ejecting head".

The first heads 11 are supported on the first side surface 71 of the support member 70 that faces in the +X direction, while the second heads 12 are supported on the second side surface 72 of the support member 70 that faces in the −X direction. Although positioned differently, the first heads 11 and the second heads 12 have the same basic configuration. In the present embodiment, the first heads 11 and the second heads 12 are disposed at positions in the +Z direction from the channel member 30. In other words, the first heads 11 and the second heads 12 are disposed below the channel member 30 with respect to the ±Z direction. The first heads 11 and the second heads 12 are hereinafter collectively referred to as "heads 10".

The apparatus body 2 is a housing that accommodates the head unit 100 and the transport unit 4 therein. The head unit 100 is mounted in the apparatus body 2. As an example, the head unit 100 and the apparatus body 2 are fixed together by mounting the support member 70 in the apparatus body 2. The support member 70 supports multiple heads 10. The channel member 30 is disposed at the upper surface of the support member 70. In other words, the channel member 30 is positioned in the −Z direction from the support member 70. The channel member 30 has fluid channels formed therein for supplying ink to each head 10, which will be described in detail later. The ink is supplied from an ink storage device, such as an ink tank or an ink cartridge in which ink is stored, through the ink tube 3.

The transport unit 4 has a first transport device 7 and a second transport device 8. The first transport device 7 is positioned in the −X direction from the heads 10, and the second transport device 8 is positioned in the +X direction from the heads 10.

The first transport device 7 is formed of a drive roller 7*a*, an idler roller 7*b*, and a transport belt 7*c* that extends around the drive roller 7*a* and the idler roller 7*b*. Similarly, the second transport device 8 is formed of a drive roller 8*a*, an idler roller 8*b*, and a transport belt 8*c*.

Each of respective drive rollers 7*a* and 8*a* of the first transport device 7 and the second transport device 8 is coupled to a driving device (not illustrated), such as a driving motor, and the driving power of the driving device rotates the transport belts 7*c* and 8*c*, thereby transporting a liquid receiving medium S in the ±X direction.

Note that the configuration of the transport unit 4 is not limited to this. The transport unit 4 may be configured differently insofar as the transport unit 4 can transport the liquid receiving medium S in the ±X direction.

In the example described above, the support member 70 that supports the heads 10 is fixed to the apparatus body 2, and the transport unit 4 transports the liquid receiving medium S. The ink jet type recording apparatus 1, however, is not limited to this configuration. For example, the ink jet type recording apparatus 1 may have a so-called serial printing configuration in which a head 10 may move reciprocally in the ±Y direction and eject ink while a liquid receiving medium S is fed and transported in the ±X direction.

The support member 70 has such a shape that the longitudinal direction thereof corresponds to the ±Y direction and the lateral direction thereof corresponds to the ±X direction. The support member 70 has the first side surface 71 and the second side surface 72. The first side surface 71 of the support member 70 is a surface facing in the +X direction. In other words, the first side surface 71 of the support member 70 can be seen when the support member 70 is viewed in the −X direction. The second side surface 72 of the support member 70 is a surface opposite to the first side surface 71 in the ±X direction, in other words, a surface that faces in the −X direction. In other words, the second side surface 72 of the support member 70 can be seen when the support member 70 is viewed in the +X direction.

The first side surface 71 and the second side surface 72 need not be flat. In the present embodiment, first head-accommodation portions 71*a* are recessed in the first side surface 71 of the support member 70, and second head-accommodation portions 72*a* are recessed in the second side surface 72.

The first heads 11 are supported on the first side surface 71 of the support member 70, and the second heads 12 are supported on the second side surface 72 of the support member 70. More specifically, each of the first heads 11 is mounted on the support member 70 in such a manner that when the first side surface 71 is viewed in the −X direction, at least a portion of the first head 11 overlaps the first side surface 71. Similarly, each of the second head 12 is mounted on the support member 70 in such a manner that when the second side surface 72 is viewed in the +X direction, at least a portion of the second head 12 overlaps the second side surface 72.

In the present embodiment, the portion of the first head 11 is accommodated in a corresponding first head-accommodation accommodation portion 71*a*, and the portion of the second head 12 is accommodated in a corresponding second head-accommodation portion 72*a*. In other words, when the first side surface 71 of the support member 70 is viewed in the −X direction, the portion of the first head 11 overlaps the corresponding first head-accommodation portion 71*a*, which is a portion of the first side surface 71. Similarly, when the second side surface 72 of the support member 70 is viewed in the +X direction, the portion of the second head 12 overlaps the corresponding second head-accommodation portion 72*a*, which is a portion of the second side surface 72.

In the present embodiment, as illustrated in FIG. 3, at least a portion of a first head 11 overlaps at least one second head 12 as viewed in the ±X direction. In other words, the first heads 11 and the second heads 12 are arranged in the ±Y direction in a staggered manner.

Figure 9:
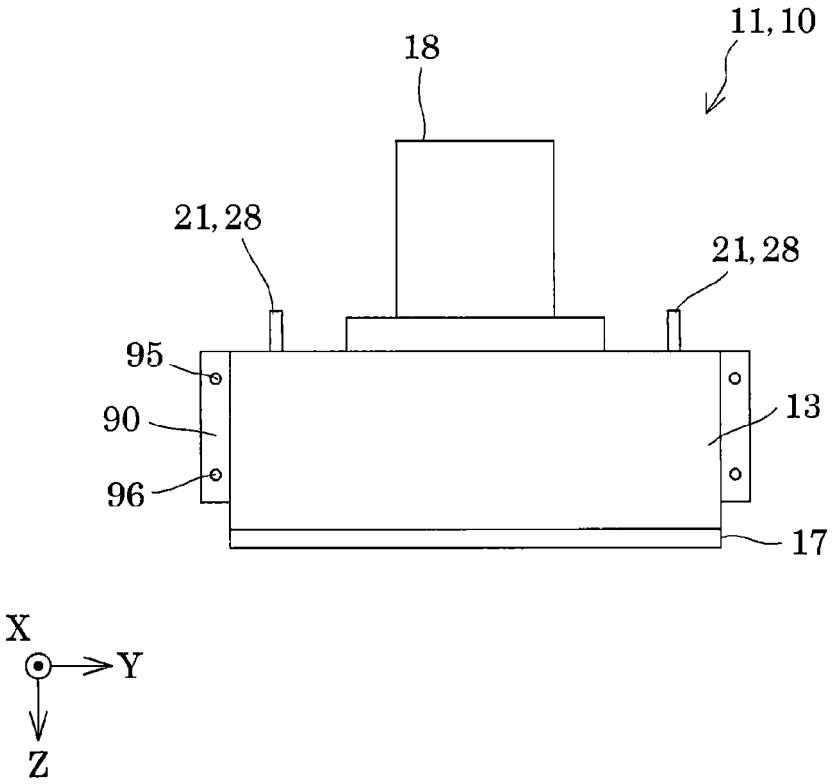
FIG. 9 is a front view illustrating a head according to Embodiment 1.
Figure 10:
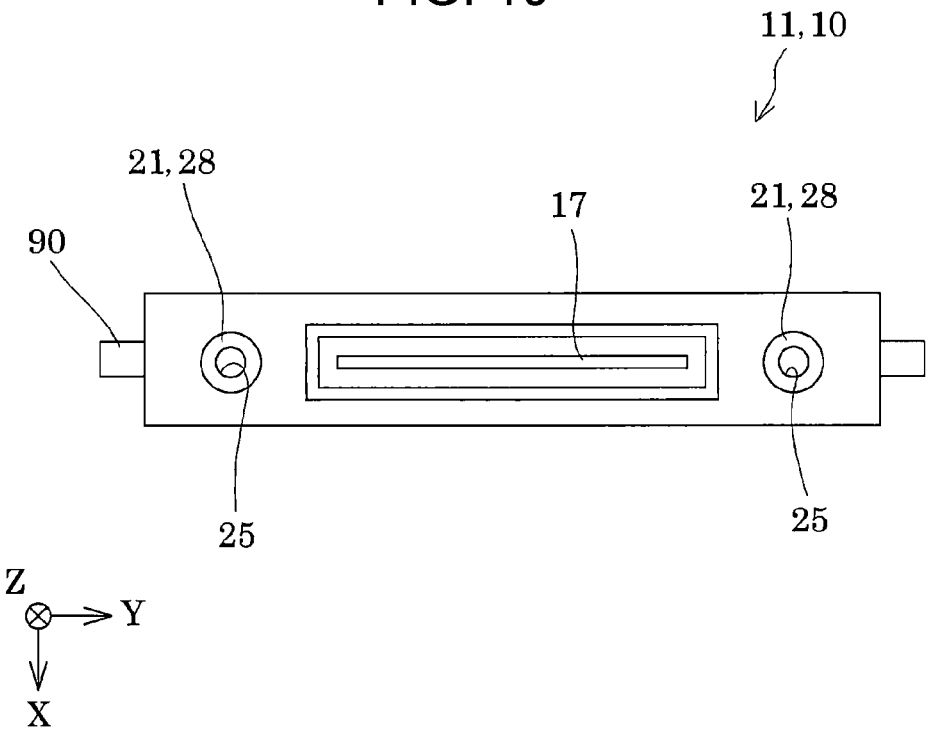
FIG. 10 is a top view illustrating the head according to Embodiment 1.
Figure 11:
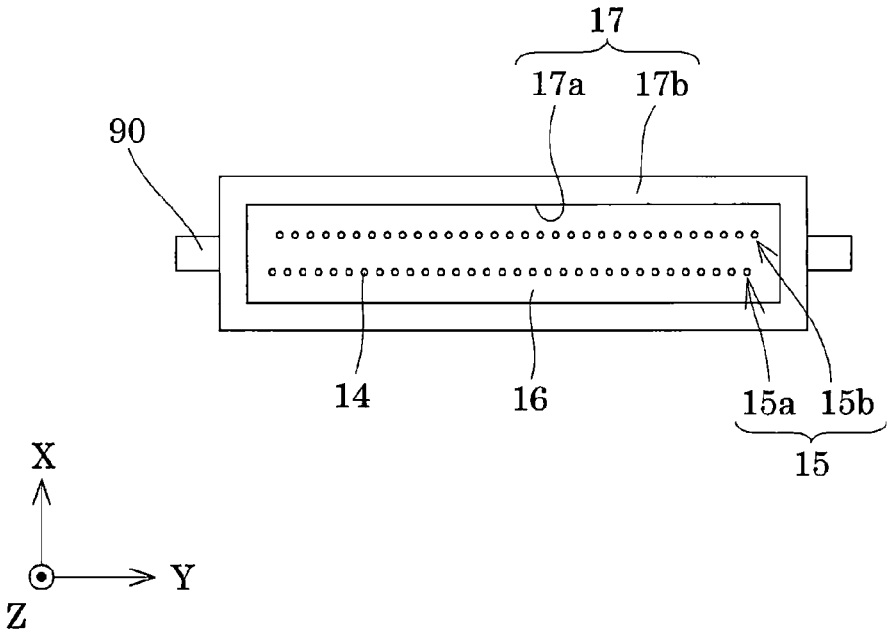
FIG. 11 is a bottom view illustrating the head according to Embodiment 1.

The following describes each head 10 in detail with reference to FIGS. 9 to 11. FIG. 9 is a front view of the head 10, FIG. 10 is a top view of the head 10, and FIG. 11 is a bottom view of the head 10.

Each head 10 includes a head body 13 to which ink is supplied from the channel member 30, and the ink is ejected in the +Z direction from nozzle orifices 14 of the head body 13. The nozzle orifices 14 are arranged so as to form nozzle rows 15. The surface at which the nozzle rows 15 are formed is a nozzle surface 16.

The nozzle rows 15 are formed by arranging the nozzle orifices 14 side by side in the ±Y direction. In the present embodiment, two nozzle rows, in other words, a nozzle row 15*a* and a nozzle row 15*b*, are formed. Each of the nozzle rows of the nozzle orifices 14 extends straight in the ±Y direction. The nozzle row 15*a* and the nozzle row 15*b* are disposed side by side in the ±X direction. The nozzle orifices 14 of the nozzle row 15*a* are formed so as to be positionally shifted by a half pitch relative to the nozzle orifices 14 of the nozzle row 15*b*. Both of the nozzle rows 15*a* and 15*b* eject the same liquid. Accordingly, the nozzle rows 15*a* and 15*b* substantially form a single set of the nozzle rows 15. The single set of the nozzle rows 15 as described above provides twice as high resolution as that of a single nozzle row 15*a* or a single nozzle row 15*b*. Note that the head 10 may have a single set of nozzle rows consisting of three nozzle rows or more or may have one nozzle row. The head 10 may have two or more sets of nozzle rows 15, and each set of the nozzle rows 15 may eject a different type of liquid.

The head body 13 has a cover head 17 disposed to protect the nozzle surface 16. The cover head 17 has a frame 17*b* that defines an opening 17*a* from which the nozzle rows 15 are exposed. The frame 17*b* protects the nozzle surface 16 by covering the periphery of the nozzle surface 16.

A pressure generation chamber and a pressure generation device, which are not illustrated, are formed inside the head body 13. The pressure generation chamber forms part of a fluid channel that communicates with each nozzle orifice 14, and the pressure generation device changes the pressure in the pressure generation chamber and thereby ejects ink from the nozzle orifice 14.

The type of the pressure generation device is not specifically limited here. For example, the pressure generation device may be a device that uses a piezoelectric element in which a piece of a piezoelectric material, which performs an electromechanical transducing function, is sandwiched by two electrodes. The pressure generation device may be a device that uses a heating device disposed in the pressure generation chamber, and liquid droplets are ejected from the nozzle orifice 14 due to bubbles being generated by the heat of the heating device. Alternatively, the pressure generation device may be a device that ejects liquid droplets from the nozzle orifice 14 due to a diaphragm being deformed by an electrostatic force generated between the diaphragm and an electrode. The piezoelectric element may be a flexural vibration device formed by laminating, in the order from the pressure generation chamber, a lower electrode, a piece of a piezoelectric material, and an upper electrode, or may be an axial vibration device formed by alternately laminating pieces of a piezoelectric material and pieces of an electrode-forming material.

The head body 13 has a connector (not illustrated) disposed on a surface of the head body 13 that is opposite to the nozzle surface 16 in the ±Z direction, in other words, disposed on the surface facing the −Z direction. The connector receives electric signals, such as signals for printing, supplied from outside. Flexible connection wiring 18, such as an FPC, for transmitting electric signals is coupled to the connector.

The head body 13 of each first head 11 has a first channel pipe 21 in which a fluid channel 25 through which ink flows is formed. The head body 13 of each second head 12 has a third channel pipe 23 in which a fluid channel 25 through which ink flows is formed. In other words, the first channel pipe 21 is disposed in the first head 11, and the third channel pipe 23 is disposed in the second head 12. In the present embodiment, the first channel pipe 21 and the third channel pipe 23 have the same configuration. The first channel pipe 21 and the third channel pipe 23 are collectively referred to as "lower channel pipes 28" when it is not necessary to distinguish the first channel pipe 21 and the third channel pipe 23 from each other.

The lower channel pipes 28 are portions to which tubes 40 are coupled, which will be described later. In the present embodiment, each lower channel pipe 28 protrudes in the −Z direction from a surface of the head body 13 that faces in the −Z direction. In other words, with respect to the ±Z direction, the lower channel pipe 28 protrudes upward from the surface of the head body 13 that is opposite to the nozzle surface 16. The lower channel pipe 28 is formed like a cylinder through which the fluid channel 25 opens so as to face in the −Z direction.

In the present embodiment, each head body 13 has two lower channel pipes 28. Ink is first supplied through a tube 40 coupled to one of the lower channel pipes 28 to a fluid channel 25, and subsequently the ink is sent to pressure generation chambers formed inside the head body 13 and ejected from the corresponding nozzle orifices 14 of the nozzle row 15*a*. Ink is also supplied through another tube 40 coupled to the other one of the lower channel pipes 28 to another fluid channel 25, and subsequently the ink is sent to pressure generation chambers formed inside the head body 13 and ejected from the corresponding nozzle orifices 14 of the nozzle row 15*b*.

A configuration for positioning the head 10 and fixing the head 10 to the support member 70 will be described with reference to FIGS. 2, 5, and 9.

As illustrated in FIGS. 2 and 5, the support member 70 has mounting recesses 74 that are formed in each of the first head-accommodation portions 71*a* and of the second head-accommodation portions 71*b*. The mounting recesses 74 are formed at opposite ends of each head-accommodation portion in the ±Y direction.

The mounting recesses 74 of each head-accommodation portion are recesses for accommodating part of the mounting portions 90 of each head 10, which will be described later. The mounting recesses 74 have respective mounting surfaces 77. The surfaces of the mounting portions 90 (to be described later) of each first head 11 come into contact with respective mounting surfaces 77 of the mounting recesses 74 of the corresponding first head-accommodation portion 71*a*, in which the surfaces of the mounting portions 90 face in the −X direction and the mounting surfaces 77 face in the +X direction. The surfaces of the mounting portions 90 of each second head 12 come into contact with respective mounting surfaces 77 of the mounting recesses 74 of the corresponding second head-accommodation portion 71*b*, in which the surfaces of the mounting portions 90 face in the +X direction and the mounting surfaces 77 face in the −X direction. The depth of each mounting recess 74 in the ±X direction is shallower compared with the depth of each first head-accommodation portion 71*a* and with the depth of each second head-accommodation portion 71*b*.

A positioning pin 75 is formed at the mounting surface 77 of each mounting recess 74 so as to protrude in the ±X direction. A fixation screw hole 76 is also formed at the mounting surface 77 so as to extend in the ±X direction and open at the mounting surface 77. In the present embodiment, a column-like positioning pin 75 is formed integrally with the support member 70. The fixation screw hole 76 is formed so as to receive a fixation screw 97 (to be described later).

As illustrated in FIGS. 2, 5, and 9, the mounting portions 90 are formed at opposite ends of each first head 11 and of each second head 12 in the ±Y direction. A mounting portion 90 protrudes from each surface of the first head 11 and the second head 12 that faces in the +Y direction, and the other mounting portion 90 protrudes from each surface thereof that faces in the −Y direction. In the ±X direction, the width of each mounting portion 90 is smaller than the width of the first head 11 and smaller than the width of the second head 12. At least a portion of each mounting portion 90 is accommodated in each mounting recess 74 of the support member 70. The mounting portion 90 is shaped so as to come into contact with a mounting surface 77.

Each of the mounting portions 90, which are formed at opposite ends of the first head 11 and of the second head 12 in the ±Y direction, has a positioning hole 95 and a fixation screw insertion hole 96, both of which penetrate through the mounting portion 90 in the ±X direction. In the present embodiment, the positioning hole 95 is formed at a position away in the −Z direction from the fixation screw insertion hole 96. The positioning hole 95 is shaped so as to enable the positioning pin 75 to enter, and the fixation screw insertion hole 96 is shaped so as to enable a fixation screw 97 (to be described later) to enter.

The positioning pin 75 positions each head 10 in the ±Y direction and in the ±Z direction. In other words, inserting a pair of the positioning pins 75 of the support member 70 into a pair of the positioning holes 95 of the head 10 fixes the position of the head 10 in the ±Y direction and in the ±Z direction with respect to the support member 70. Put another way, inserting the positioning pins 75 into the positioning holes 95 prevents the head 10 from moving in the ±Y direction and in the ±Z direction.

The heads 10 are mounted in the first head-accommodation portions 71*a* and the second head-accommodation portions 71*b* of the support member 70 with the heads 10 being prevented from moving along the YZ-plane as described above. In this state, fixation screws 97 are inserted into respective fixation screw insertion holes 96 of the heads 10 and screwed into the fixation screw holes 76 of the support member 70. The heads 10 are thus fixed to the first head-accommodation portions 71*a* and the second head-accommodation portions 71*b*. The heads 10 can be detached from the support member 70 by unscrewing the fixation screws 97. In other words, the heads 10 can be individually removed from the support member 70 for replacement.

The support member 70 may be formed of a resin by molding, or of ceramics or a metal, to have a higher rigidity. In the case of the head unit 100 having multiple heads, it is preferable to use a metal for the support member 70 because of its high rigidity.

In the case of the positioning pins 75 being formed in the support member 70, it is preferable that the support member 70 be made of a metal. The heads 10 are replaceable components, but the support member 70 is not. Forming the support member 70 of a metallic material reduces the likelihood of the positioning pins 75 of the support member 70 being broken due to repeated replacement of the heads 10. This can prevent replacement of the entire support member 70 merely due to a positioning pin 75 being broken.

As illustrated in FIGS. 2 to 7, ink is supplied to the above-described heads 10 from the channel member 30. Inside the channel member 30, a fluid channel 37A and a fluid channel 37B are formed for delivering ink to the heads 10. More specifically, the fluid channel 37A supplies ink to the first heads 11, and the fluid channel 37B supplies ink to the second heads 12. The fluid channels 37A and 37B are collectively referred to as "fluid channels 37" when it is not necessary to distinguish the fluid channels 37A and 37B from each other. The channel member 30 is disposed above the support member 70 in the ±Z direction, in other words, the channel member 30 is positioned in the −Z direction from the support member 70. The channel member 30 also has second channel pipes 22 and fourth channel pipes 24. A fluid channel 36 through which ink flows is formed in each of the second channel pipes 22 and the fourth channel pipes 24. The second channel pipes 22 and the fourth channel pipes 24 are collectively referred to as "upper channel pipes 29" when it is not necessary to distinguish the second channel pipes 22 from the fourth channel pipes 24. The fluid channel 37A has one end that is in communication with the ink tube 3, and the fluid channel 37A has opposite ends that are in communication with the fluid channels 36 of respective second channel pipes 22 of the first heads 11. Similarly, the fluid channel 37B has one end that is in communication with the ink tube 3, and the fluid channel 37B has opposite ends that are in communication with the fluid channels 36 of respective fourth channel pipes 24 of the second heads 12.

The upper channel pipes 29 are portions to which tubes 40 are coupled, which will be described later. In the present embodiment, each upper channel pipe 29 protrudes in the +Z direction from a surface of the channel member 30 that faces the support member 70. The upper channel pipe 29 is formed like a cylinder through which the fluid channel 36 opens so as to face in the +Z direction.

The number of the upper channel pipes 29 is the same as that of the lower channel pipes 28 formed in the heads 10. Each upper channel pipe 29 is disposed so as to substantially overlap a corresponding one of the lower channel pipes 28 as viewed in the ±Z direction. In other words, each second channel pipe 22 is disposed so as to substantially overlap a corresponding one of the first channel pipes 21 of the first heads 11 as viewed in the ±Z direction. Each fourth channel pipe 24 is disposed so as to substantially overlap a corresponding one of the third channel pipes 23 of the second heads 12 as viewed in the ±Z direction.

Ink is supplied to the fluid channels 37 of the channel member 30 from an ink tank or the like through the ink tube 3. The ink supplied to the fluid channels 37 is sent to the heads 10 through the fluid channels 36 of the upper channel pipes 29 and also through the tubes 40 coupled to respective upper channel pipes 29.

Note that the upper channel pipes 29 and the lower channel pipes 28 serve not only as fluid channels for the ink supplied to the heads 10 but also may serve as fluid channels for the ink returning from the heads 10. For example, in the case of providing two upper channel pipes 29 and two lower channel pipes 28 for each head 10, ink is supplied to the head 10 via one of the upper channel pipes 29, a tube 40, and one of the lower channel pipes 28. The ink not ejected from the head 10 may be returned to the channel member 30 and further to the ink tank or the like via the other lower channel pipe 28, the other tube 40, and the other upper channel pipe 29.

First tubes 41 are flexible tubes that communicate the first channel pipes 21 with corresponding second channel pipes 22. Each first tube 41 has a first end portion 51 and a second end portion 52 that is opposite to the first end portion 51. The first end portion 51 is coupled to a first channel pipe 21, and the second end portion 52 is coupled to a second channel pipe 22.

Second tubes 42 are flexible tubes that communicate the third channel pipe 23 with respective fourth channel pipes 24. Each second tube 42 has a third end portion 53 and a fourth end portion 54 that is opposite to the third end portion 53. The third end portion 53 is coupled to a third channel pipe 23, and the fourth end portion 54 is coupled to a fourth channel pipe 24.

In the present embodiment, the first tubes 41 and the second tubes 42 are made of a resin and extend substantially straight in the ±Z direction. As illustrated in FIG. 6, the longitudinal length H1 of each first tube 41 is shorter than a dimension (height) H2 of each first head 11 in the ±Z direction. Similarly, the longitudinal length H3 of each second tube 42 is shorter than a dimension (height) H4 of each second head 12 in the ±Z direction. Note that the dimensions (heights) H2 and H4 of the corresponding heads 10 in the ±Z direction are defined as the distance between the surface of the head 10 that faces in the +Z direction and the surface of the head 10 from which the lower channel pipes 28 protrude.

As illustrated in FIG. 8, the first tube 41 is formed of a member having such characteristics that with respect to a horizontal plane (i.e., an XY-plane in the present embodiment), the second end portion 52 of the first tube 41 opens on a side opposite to the gravity direction (i.e., on the side positioned in the −Z direction from a horizontal plane in the present embodiment) when the first end portion 51 of the first tube 41 is coupled to a corresponding first channel pipe 21 and the second end portion 52 of the first tube 41 is free (i.e., not coupled to the second channel pipe 22) in the state of the first channel pipe 21 protruding in a direction opposite to the gravity direction (i.e., protruding in the −Z direction in the present embodiment). That "with respect to a horizontal plane, the second end portion 52 of the first tube 41 opens on a side opposite to the gravity direction" means that the opening of the second end portion 52 of the first tube 41 can be seen as viewed in the +Z direction. Accordingly, the first tube 41 may stand upright in the ±Z direction or may stand such that a portion of the tube that includes the second end portion 52 inclines with respect to the ±Z direction as illustrated in FIG. 8. The above-described characteristics can be obtained, for example, by adjusting the rigidity, wall thickness, and length of the first tube 41 appropriately.

The second tube 42 is formed of a member having such characteristics that with respect to a horizontal plane (i.e., an XY-plane in the present embodiment), the fourth end portion 54 of the second tube 42 opens on a side opposite to the gravity direction when the third end portion 53 of the second tube 42 is coupled to the corresponding third channel pipe 23 and the fourth end portion 54 of the second tube 42 is free (i.e., not coupled to the fourth channel pipe 24 in the present embodiment) in the state of the third channel pipe 23 protruding in a direction opposite to the gravity direction (i.e., protruding in the −Z direction in the present embodiment). That "with respect to a horizontal plane, the fourth end portion 54 of the second tube 42 opens on a side opposite to the gravity direction" means that the opening of the fourth end portion 54 of the second tube 42 can be seen as viewed in the +Z direction. Accordingly, the second tube 42 may stand upright in the ±Z direction or may stand such that a portion of the tube that includes the fourth end portion 54 inclines with respect to the ±Z direction, as is the case for the second end portion 52 illustrated in FIG. 8. The above-described characteristics can be obtained, for example, by adjusting the rigidity, wall thickness, and length of the second tube 42 appropriately.

The first tube 41 and the second tube 42 are collectively referred to as "tubes 40" when it is not necessary to distinguish the first tube 41 from the second tube 42. The first end portion 51 and the third end portion 53 are collectively referred to as "lower end portions 58" when it is not necessary to distinguish the first end portion 51 from the third end portion 53. The second end portion 52 and the fourth end portion 54 are collectively referred to as "upper end portions 59" when it is not necessary to distinguish the second end portion 52 from the fourth end portion 54.

As illustrated in FIG. 7, a tube 40 is coupled to a corresponding lower channel pipe 28 in such a manner that the lower end portion 58 of the tube 40 covers the outer periphery of the lower channel pipe 28. Similarly, the tube 40 is coupled to a corresponding upper channel pipe 29 in such a manner that the upper end portion 59 of the tube 40 covers the outer periphery of the upper channel pipe 29.

In the present embodiment, the outside diameter W1 of the lower channel pipe 28 is the same as the outside diameter W2 of the upper channel pipe 29. The inside diameter of each tube 40 is substantially constant and smaller than the outside diameter W1 of the lower channel pipe 28 and than the outside diameter W2 of the upper channel pipe 29. The tube 40 is flexible and elastically deformable. The lower end portion 58 and the upper end portion 59 are coupled to the lower channel pipe 28 and the upper channel pipe 29, respectively, in such a manner that these end portions cover the corresponding channel pipes while the inside diameters of these end portions are expanded. Here, the outside diameter W1 of the lower channel pipe 28 is defined as a maximum outside diameter of a portion of the lower channel pipe 28 that is covered by the lower end portion 58 of the tube 40. Similarly, the outside diameter W2 of the upper channel pipe 29 is defined as a maximum outside diameter of a portion of the upper channel pipe 29 that is covered by the upper end portion 59 of the tube 40.

A member that fixes a first tube 41 to a corresponding first channel pipe 21 is a first fixation member 61. The first fixation member 61 tightly fastens the first end portion 51 of the first tube 41 from outside. A member that fixes a second tube 42 to a corresponding third channel pipe 23 is a second fixation member 62. The second fixation member 62 tightly fastens the third end portion 53 of the second tube 42 from outside. The first fixation member 61 and the second fixation member 62 are hereinafter collectively referred to as "fixation members 60" when it is not necessary to distinguish the first fixation members 61 from the second fixation member 62.

In the present embodiment, each fixation member 60 is formed of a material, such as a metal or a resin, into a cylindrical shape. The fixation member 60 that fastens the lower end portion 58 from outside is shaped as follows. The inside diameter of the fixation member 60 is greater than the outside diameter of the lower channel pipe 28 and smaller than the outside diameter of the lower end portion 58 of the tube 40 when the tube 40 is coupled to the lower channel pipe 28 but the fixation member 60 is not attached. The fixation member 60 configured as such fixes the tube 40 to the lower channel pipe 28 in such a manner that the fixation member 60 slightly squashes the lower end portion 58 of the tube 40 and thereby fastens the lower channel pipe 28 tightly from outside.

As described above, the lower end portion 58 of each tube 40 is fixed to the corresponding lower channel pipe 28 using the fixation member 60. However, the upper end portion 59 of the tube 40 is fixed to the upper channel pipe 29 without using the fixation member 60. With this configuration, a first fixation strength between the tube 40 and the lower channel pipe 28 is greater than a second fixation strength between the tube 40 and the upper channel pipe 29. In the present embodiment, the second fixation strength is derived from the elastic force of the tube 40. On the other hand, the first fixation strength is derived from the elastic force of the tube 40 and also from the tightening force of the fixation member 60 acting on the tube 40 from outside. Accordingly, the first fixation strength is greater than the second fixation strength.

When a head 10 is unscrewed and removed from the support member 70 by pulling the head 10 in the +Z direction, in other words, in the direction in which the tubes 40 are stretched, only the upper end portion 59 of each tube 40 is detached from the upper channel pipe 29 while the lower end portion 58 remains to be fixed to the lower channel pipe 28 because the first fixation strength is set to be greater than the second fixation strength.

Accordingly, in the ink jet type recording apparatus 1 according to the present embodiment, when a head 10 needs to be replaced, the head 10 can be detached from the channel member 30 with the tubes 40 being coupled securely to the lower channel pipes 28 of the head 10. Thus, the tubes 40 can be replaced simultaneously with the replacement of the head 10, which can improve replacement performance of the head 10. When the head 10 is detached from the channel member 30, the tubes 40 remain to be coupled to the head 10, which reduces the likelihood of the residual ink spilling out of the tubes 40.

The ink jet type recording apparatus 1 according to the present embodiment has a structure for guiding the tubes 40 to predetermined positions. More specifically, as illustrated in FIGS. 6 and 7, the support member 70 includes first guide grooves 81 and second guide grooves 82, which are examples of "guide portions". The first guide grooves 81 and the second guide grooves 82 are hereinafter collectively referred to as "guide grooves 80" when it is not necessary to distinguish the first guide grooves 81 from the second guide grooves 82.

Each first guide groove 81 has a contact region R to come into contact with the outer peripheral surface of the first fixation member 61. The first guide groove 81 guides the first tube 41 while the contact region R is in contact with the outer peripheral surface of the first fixation member 61.

In the present embodiment, the first guide groove 81 is a groove formed in the first side surface 71 of the support member 70 so as to extend in the ±Z direction. The first guide groove 81 has a semicircular cross section along an XY-plane, and the shape of the first guide groove 81 matches the outer peripheral surface of the first fixation member 61. The number of the first guide grooves 81 is the same as the number of the first channel pipes 21 of the first heads 11 to be fixed to the first side surface 71. The contact region R is a surface portion of each first guide groove 81. The contact region R is positioned near the end of the first guide groove 81 that is closer to the first head 11 in the ±Z direction, in other words, positioned near the end facing in the +Z direction.

Due to the first guide groove 81 guiding the first tube 41 while the contact region R of the first guide groove 81 is in contact with the outer peripheral surface of the first fixation member 61, the second end portion 52 of the first tube 41 is caused to come under the second channel pipe 22 in the ±Z direction while the first fixation member 61 that fixes the first tube 41 is in contact with the contact region R. In other words, in the state of the first guide groove 81 guiding the first fixation member 61 and the first tube 41, the first tube 41 can be coupled to the second channel pipe 22 by moving the first head 11 in the −Z direction toward the second channel pipe 22. This can reduce the amount of positional adjustment of the first tube 41 in the ±X direction and in the ±Y direction. The first tube 41 can be thereby coupled smoothly to the second channel pipe 22.

The second guide grooves 82 are configured similarly to the first guide grooves 81. Each second guide groove 82 has a contact region R to come into contact with the outer peripheral surface of the second fixation member 62. The second guide groove 82 guides the second tube 42 while the contact region R is in contact with the outer peripheral surface of the second fixation member 62.

In the present embodiment, the second guide groove 82 is a groove formed in the second side surface 72 of the support member 70 so as to extend in the ±Z direction. The second guide groove 82 has a semicircular cross section along an XY-plane, and the shape of the second guide groove 82 matches the outer peripheral surface of the second fixation member 62. The number of the second guide grooves 82 is the same as the number of the third channel pipes 23 of the second heads 12 to be fixed to the second side surface 72.

The contact region R is a surface portion of each second guide groove 82. The contact region R is positioned near the end of the second guide groove 82 that is closer to the second head 12 in the ±Z direction, in other words, positioned near the end facing in the +Z direction.

Due to the second guide groove 82 guiding the second tube 42 while the contact region R of the second guide groove 82 is in contact with the outer peripheral surface of the second fixation member 62, the fourth end portion 54 of the second tube 42 is caused to come under the fourth channel pipe 24 in the ±Z direction while the second fixation member 62 that fixes the second tube 42 is in contact with the contact region R. In other words, in the state of the second guide groove 82 guiding the second fixation member 62 and the second tube 42, the second tube 42 can be coupled to the fourth channel pipe 24 by moving the second head 12 in the −Z direction toward the fourth channel pipe 24. This can reduce the amount of positional adjustment of the second tube 42 in the ±X direction and in the ±Y direction. The second tube 42 can be thereby coupled smoothly to the fourth channel pipe 24.

As illustrated in FIG. 3, the first guide grooves 81 are formed at positions different from those of the second guide grooves 82 in the ±Y direction. In other words, the first guide grooves 81 do not overlap the second guide grooves 82 as viewed in the ±X direction.

The hardness of the first fixation member 61 is higher than that of the first tube 41. Moreover, the hardness of a portion in which the first guide groove 81 is formed (hereinafter referred to as "the hardness of the first guide groove 81") is higher than that of the first tube 41. In the present embodiment, the hardness of the first guide groove 81 means the hardness of the support member 70. In addition, the hardness of the first fixation member 61 is lower than the hardness of the first guide groove 81. Note that as used herein, the hardness means the degree of the resistance of a material to being scratched when the material is scratched with another material. For example, the hardness can be obtained using the Vickers hardness test or the Mohs hardness test. For example, when two materials are rubbed against each other, one material that is more susceptible to scratches may be regarded as having a low hardness and the other material may be regarded as having a high hardness.

The first tube 41 is guided indirectly by the first guide groove 81 with the first fixation member 61 interposed therebetween. This indirect guidance can prevent the first tube 41 from being in contact, or in frequent contact, with the first guide groove 81. In addition to this configuration with which the first tube 41 is prevented from physically coming into contact, or into frequent contact, with the first guide groove 81, the hardness relationship is set as described above. As a result, the likelihood of the first tube 41 being worn down by the first guide groove 81 can be reduced.

The hardness of the second fixation member 62 is higher than that of the second tube 42. Moreover, the hardness of a portion in which the second guide groove 82 is formed, in other words, the hardness of the second guide groove 82, is higher than that of the second tube 42. In the present embodiment, the hardness of the second guide groove 82 is the hardness of the support member 70. In addition, the hardness of the second fixation member 62 is lower than the hardness of the second guide groove 82.

The second tube 42 is guided indirectly by the second guide groove 82 with the second fixation member 62 interposed therebetween. This indirect guidance can prevent the second tube 42 from being in contact, or in frequent contact, with the second guide groove 82. In addition to this configuration with which the second tube 42 is prevented from physically coming into contact, or into frequent contact, with the second guide groove 82, the hardness relationship is set as described above. As a result, the likelihood of the second tube 42 being worn down by the second guide groove 82 can be reduced.

As described above, in the case of the support member 70 being made of a metal, more specifically, in the case of the first guide groove 81 and the second guide groove 82 being formed in the metallic support member 70, the first tube 41 and the second tube 42 are susceptible to wear when these tubes are made of a soft material. In this case, however, the ink jet type recording apparatus 1 is configured to have the first fixation member 61 and the second fixation member 62 that have a hardness higher than that of the first tubes 41 and the second tube 42, which provides an advantageous effect that the first tube 41 and the second tube 42 are not worn down by coming into contact with the first guide groove 81 and the second guide groove 82

In summary, the ink jet type recording apparatus 1 according to the present embodiment includes the first head 11 having the first channel pipe 21, the channel member 30 having the second channel pipe 22, and the first tube 41 that communicates the first channel pipe 21 with the second channel pipe 22. The first tube 41 is coupled to the first channel pipe 21 and the second channel pipe 22 in such a manner that the first end portion 51 of the first tube 41 covers the outer periphery of the first channel pipe 21 and the second end portion 52 of the first tube 41 covers the outer periphery of the second channel pipe 22. The first fixation strength, which is the fixation strength between the first tube 41 and the first channel pipe 21, is greater than the second fixation strength, which is the fixation strength between the first tube 41 and the second channel pipe 22.

Accordingly, in the ink jet type recording apparatus 1 according to the present embodiment, when the first head 11 needs to be replaced, the first head 11 can be detached from the channel member 30 with the first tube 41 being coupled securely to the first channel pipe 21 of the first head 11. Thus, the first tube 41 can be replaced simultaneously with the replacement of the first head 11, which can improve replacement performance of the first head 11. Moreover, when the first head 11 is detached from the channel member 30, the first tube 41 remains to be coupled to the first head 11, which reduces the likelihood of the residual ink spilling out of the first tube 41.

The ink jet type recording apparatus 1 according to the present embodiment also includes the first fixation member 61 that fastens the first end portion 51 tightly from outside and thereby fixes the first tube 41 to the first channel pipe 21. Accordingly, in the ink jet type recording apparatus 1, the first fixation member 61 can improve the fixation strength between the first tube 41 and the first channel pipe 21 of the first head 11.

The ink jet type recording apparatus 1 according to the present embodiment also includes the first guide groove 81, in other words, the guide portion, that has a contact region R to be in contact with the outer peripheral surface of the first fixation member 61 and that is configured to guide the first tube 41 while the contact region R is in contact with the outer peripheral surface of the first fixation member 61. The hardness of the first fixation member 61 is higher than that of the first tube 41, and the hardness of the first guide groove 81 is higher than that of the first tube 41.

As described above, when the first tube 41 is coupled to the channel member 30, the first guide groove 81 guides the first tube 41 indirectly with the first fixation member 61 interposed therebetween. Even when the first guide groove 81 having a higher hardness guides the first tube 41 having a lower hardness, the ink jet type recording apparatus 1 can reduce the likelihood of the outer peripheral surface of the first tube 41 being worn down or changed in shape due to the first tube 41 coming into contact with the first guide groove 81.

In the ink jet type recording apparatus 1 according to the present embodiment, the hardness of the first fixation member 61 is lower than the hardness of the first guide groove 81, which is an example of the guide portion.

Accordingly, the ink jet type recording apparatus 1 can reduce the likelihood of the first guide groove 81 being worn down, for example, by the first fixation member 61. In other words, the shape of the first guide groove 81 can be maintained, which reduces the likelihood of the first guide groove 81 guiding the first fixation member 61 inaccurately. The first fixation member 61 may be worn down due to the first fixation member 61 coming into contact with the first guide groove 81. The first fixation member 61, however, is included in the first head 11, which is a replaceable component. Accordingly, the first fixation member 61 can be replaced easily.

Similarly, the hardness of the second fixation member 62 is lower than the hardness of the second guide groove 82. Accordingly, the ink jet type recording apparatus 1 can reduce the likelihood of the second guide groove 82 being worn down by the second fixation member 62. In other words, the shape of the second guide groove 82 can be maintained, which reduces the likelihood of the second guide groove 82 guiding the second fixation member 62 inaccurately. The second fixation member 62 may be worn down due to the second fixation member 62 coming into contact with the second guide groove 82. The second fixation member 62, however, is included in the second head 12, which is a replaceable component. Accordingly, the second fixation member 62 can be replaced easily.

In the ink jet type recording apparatus 1 according to the present embodiment, the first guide groove 81, which serves as the guide portion, is formed in the support member 70. Accordingly, in the ink jet type recording apparatus 1, when the first tube 41 is coupled to the channel member 30, the first guide groove 81 can guide the first tube 41 using the first fixation member 61 having a higher hardness instead of directly guiding the first tube 41. As a result, the outer peripheral surface of the first tube 41 is not rubbed against the first guide groove 81 of the support member 70, which suppresses the shape change of the first tube 41. The first tube 41 is guided indirectly by the first guide groove 81 with the first fixation member 61 interposed therebetween. This indirect guidance can prevent the first tube 41 from being in contact, or in frequent contact, with the first guide groove 81, which can reduce the wear of the first tube 41.

The ink jet type recording apparatus 1 according to the present embodiment includes the second head 12 having the third channel pipe 23 and also includes the second tube 42 having the third end portion 53 and the fourth end portion 54. The channel member 30 has the fourth channel pipe 24. The second tube 42 communicates the third channel pipe 23 with the fourth channel pipe 24. The second tube 42 is coupled to the third channel pipe 23 in such a manner that the third end portion 53 covers the outer periphery of the third channel pipe 23. The second tube 42 is also coupled to the fourth channel pipe 24 in such a manner that the fourth end portion 54 covers the outer periphery of the fourth channel pipe 24. The first fixation strength, which is the fixation strength between the second tube 42 and the third channel pipe 23, is greater than the second fixation strength, which is the fixation strength between the second tube 42 and the fourth channel pipe 24.

Accordingly, the ink jet type recording apparatus 1 according to the present embodiment can improve replacement performance of the second head 12, as is the case for the first head 11 described above. In other words, in the case of the ink jet type recording apparatus 1 having multiple liquid ejecting heads, the replacement performance of the liquid ejecting heads can be improved.

The ink jet type recording apparatus 1 according to the present embodiment also includes the second fixation member 62 that fastens the third end portion 53 tightly from outside and thereby fixes the second tube 42 to the third channel pipe 23. The hardness of the second guide groove 82, which is an example of the guide portion, is higher than that of the second tube 42, and the hardness of the second fixation member 62 is higher than that of the second tube 42. The support member 70 is shaped such that the longitudinal direction thereof corresponds to the ±Y direction and the lateral direction corresponds to the ±X direction. The first head 11 and the second head 12 are held by the support member 70. At least a portion of the first head 11 overlaps the second head 12 as viewed in the ±X direction. The first guide groove 81 is formed at the first side surface 71 of the support member 70. The second tube 42 is guided while the outer peripheral surface of the second fixation member 62 is in contact with the second guide groove 82 formed in the second side surface 72 of the support member 70. The first guide groove 81 is formed at a position different from that of the second guide groove 82 in the ±Y direction.

If the first guide groove 81 and the second guide groove 82 were disposed at the same position in the ±Y direction, it would be necessary to increase, to a certain extent, the thickness of the support member 70 between the first guide groove 81 and the second guide groove 82 in the ±X direction in order to obtain rigidity. Obtaining the rigidity requires an increase in the width of the support member 70 in the ±X direction. The ink jet type recording apparatus 1 according to the present embodiment, however, has the first guide groove 81 and the second guide groove 82 that are positioned differently in the ±Y direction. Accordingly, it is not necessary to increase the width of the support member 70 in the ±X direction to obtain the thickness between the first guide groove 81 and the second guide groove 82. In other words, according to the present embodiment, the size of the ink jet type recording apparatus 1 can be reduced in the ±X direction without sacrificing the rigidity of the support member 70. Note that the first guide groove 81 and the second guide groove 82 of the ink jet type recording apparatus may be formed at the same position in the ±Y direction or may be formed such that at least portions thereof overlap each other.

As described above, when the second tube 42 is coupled to the channel member 30, the second guide groove 82 guides the second tube 42 indirectly by using the second fixation member 62. Accordingly, even when the second guide groove 82 having a higher hardness guides the second tube 42 having a lower hardness, the ink jet type recording apparatus 1 can reduce the likelihood of the outer peripheral surface of the second tube 42 being worn down or changed in shape due to the second tube 42 coming into contact with the second guide groove 82.

In the ink jet type recording apparatus 1 according to the present embodiment, as viewed in the ±X direction, a portion of the first head 11 overlaps a portion of the second head 12, and the first guide groove 81 does not overlap the second guide groove 82. With this configuration, the ink jet type recording apparatus 1 can be reduced in size in the ±X direction since it is not necessary to increase the width of the support member 70 in the ±X direction in order to obtain an appropriate thickness between the first guide groove 81 and the second guide groove 82 as described above.

In the ink jet type recording apparatus 1 according to the present embodiment, the first head 11 is positioned in the +Z direction from the channel member 30. In addition, the first channel pipe 21 protrudes from the first head 11 in the −Z direction, which is opposite to the +Z direction, and the second channel pipe 22 protrudes from the channel member 30 in the +Z direction. Moreover, the first tube 41 is coupled to the first channel pipe 21 and the second channel pipe 22 in such a manner that the first tube 41 extends substantially straight in the ±Z direction. When the first head 11 needs to be replaced, it is not necessary to bend the first tube 41 or to hold the first tube 41 obliquely, which facilitates coupling of the first tube 41. The same applies to the second head 12 and the second tube 42. In the replacement of the second head 12, the second tube 42 can be coupled easily.

In the ink jet type recording apparatus 1 according to the present embodiment, the longitudinal length H1 of the first tube 41 is shorter than the dimension H2 of the first head 11 in the ±Z direction. The ink jet type recording apparatus 1 configured as above can reduce the likelihood of the first tube 41 bending and causing the opening of the second end portion 52 to face downward (i.e., in the +Z direction) after the first head 11 is detached. This can reduce the likelihood of the residual ink spilling out of the first tube 41. The same applies to the second head 12 and the second tube 42. The likelihood of the residual ink spilling out of the second tube 42 can be reduced after the second head 12 is detached.

In the ink jet type recording apparatus 1 according to the present embodiment, the first tube 41 is formed of a member having such characteristics that with respect to a horizontal plane (an XY-plane), the second end portion 52 of the first tube 41 opens on a side opposite to the gravity direction when the first end portion 51 of the first tube 41 is coupled to the first channel pipe 21 and the second end portion 52 is free (i.e., not coupled to the second channel pipe 22) in the state of the first channel pipe 21 protruding in a direction opposite to the gravity direction (i.e., protruding in the −Z direction). Forming the first tube 41 of such a member reduces the likelihood of the first tube 41 bending and causing the second end portion 52 to face downward (in the +Z direction) after the first head 11 is detached. This can reduce the likelihood of the residual ink spilling out of the first tube 41. The same applies to the second head 12 and the second tube 42. The likelihood of the residual ink spilling out of the second tube 42 can be reduced after the second head 12 is detached.

Embodiment 2

In Embodiment 1, the first fixation member 61 causes the first fixation strength (i.e., the fixation strength between the first tube 41 and the first channel pipe 21) to be greater than the second fixation strength (i.e., the fixation strength between the first tube 41 and the second channel pipe 22). In Embodiment 2, other configurations to increase the fixation strength will be described.

Figure 12:
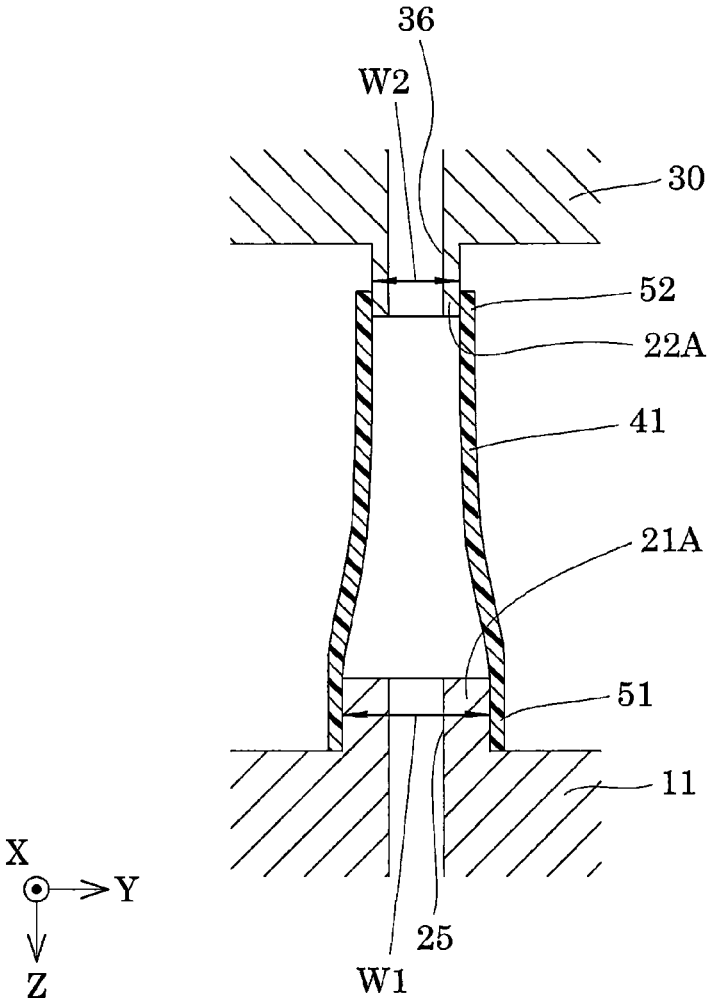
FIG. 12 is a cross-sectional view illustrating a first channel pipe, a second channel pipe, and a first tube according to Embodiment 2.

FIG. 12 is a cross-sectional view illustrating a first channel pipe 21A, a second channel pipe 22A, and a first tube 41 according to the present embodiment. Note that elements similar to those described in Embodiment 1 will be denoted by the same reference symbols, and duplicated explanations will be omitted.

The first tube 41 is similar to that of Embodiment 1 and formed into a cylindrical shape with a constant inside diameter. The first channel pipe 21A and the second channel pipe 22A are shaped similarly to those of Embodiment 1 but have different maximum outside diameters. More specifically, a maximum outside diameter W1 of the first channel pipe 21A is greater than a maximum outside diameter W2 of the second channel pipe 22A. The maximum outside diameter above is defined as a maximum outside diameter of a portion of the first channel pipe 21A to be covered with the first tube 41. The same applies to the second channel pipe 22A. In the example illustrated, the maximum diameter is the outside diameter of the first channel pipe 21A since the first channel pipe 21A has a cylindrical shape with a constant outside diameter. The same applies to the second channel pipe 22A.

When the first tube 41 is coupled to the first channel pipe 21A and to the second channel pipe 22A, the first end portion 51 of the first tube 41 is expanded more than the second end portion 52 to cover the outer peripheral surface of the first channel pipe 21A. Accordingly, compared with the second end portion 52, the first end portion 51 exerts a greater elastic force on the first channel pipe 21A when the first end portion 51 is coupled to the first channel pipe 21A. This causes the first fixation strength between the first tube 41 and the first channel pipe 21A to be greater than the second fixation strength between the first tube 41 and the second channel pipe 22A.

As is the case for Embodiment 1, in the ink jet type recording apparatus 1 configured as described above, when the first head 11 needs to be replaced, the first head 11 can be detached from the channel member 30 with the first tube 41 being coupled securely to the first channel pipe 21A of the first head 11. Thus, the first tube 41 can be replaced simultaneously with the replacement of the first head 11, which can improve replacement performance of the first head 11. Moreover, when the first head 11 is detached from the channel member 30, the first tube 41 remains to be coupled to the first head 11, which reduces the likelihood of the residual ink spilling out of the first tube 41.

Note that this shape configuration for the first channel pipe 21A and the second channel pipe 22A can be applied to the third channel pipe 23 and the fourth channel pipe 24.

Figure 13:
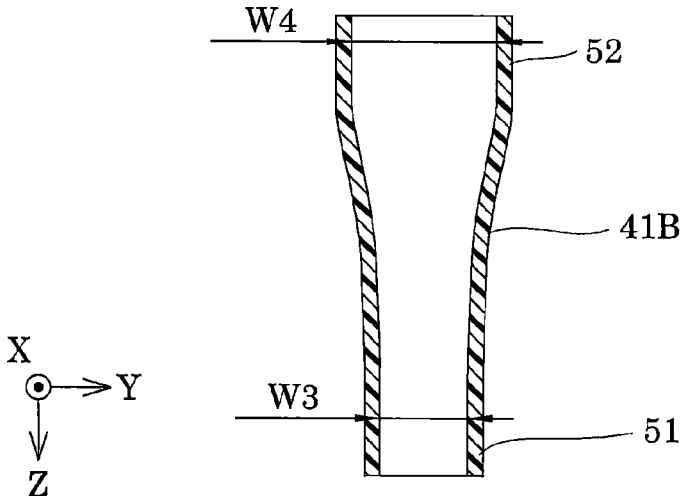
FIG. 13 is a cross-sectional view illustrating the first tube according to Embodiment 2.

FIG. 13 is a cross-sectional view illustrating a first tube 41B according to another example of Embodiment 2. Note that elements similar to those described in Embodiment 1 will be denoted by the same reference symbols, and duplicated explanations will be omitted. As illustrated, the first tube 41B is configured such that the inside diameter W3 of the first end portion 51 is smaller than the inside diameter W4 of the second end portion 52. Note that the inside diameter W3 of the first end portion 51 and the inside diameter W4 of the second end portion 52 are to be measured when the first tube 41B is not coupled to the first and second channel pipes 21 and 22.

When the first tube 41B is coupled to the first channel pipe 21 and the second channel pipe 22, which are configured as described in Embodiment 1, the first end portion 51 of the first tube 41 covers the outer peripheral surface of the first channel pipe 21 and exerts a greater elastic force thereto compared with the second end portion 52. In other words, the first fixation strength between the first tube 41B and the first channel pipe 21 becomes greater than the second fixation strength between the first tube 41B and the second channel pipe 22.

As is the case for Embodiment 1, in the ink jet type recording apparatus 1 configured as described above, when the first head 11 needs to be replaced, the first head 11 can be detached from the channel member 30 with the first tube 41B being coupled securely to the first channel pipe 21 of the first head 11. Thus, the first tube 41B can be replaced simultaneously with the replacement of the first head 11, which can improve replacement performance of the first head 11. Moreover, when the first head 11 is detached from the channel member 30, the first tube 41B remains to be coupled to the first head 11, which reduces the likelihood of the residual ink spilling out of the first tube 41B.

Note that the shape configuration for the first tube 41B can be applied to the second tube.

Figure 14:
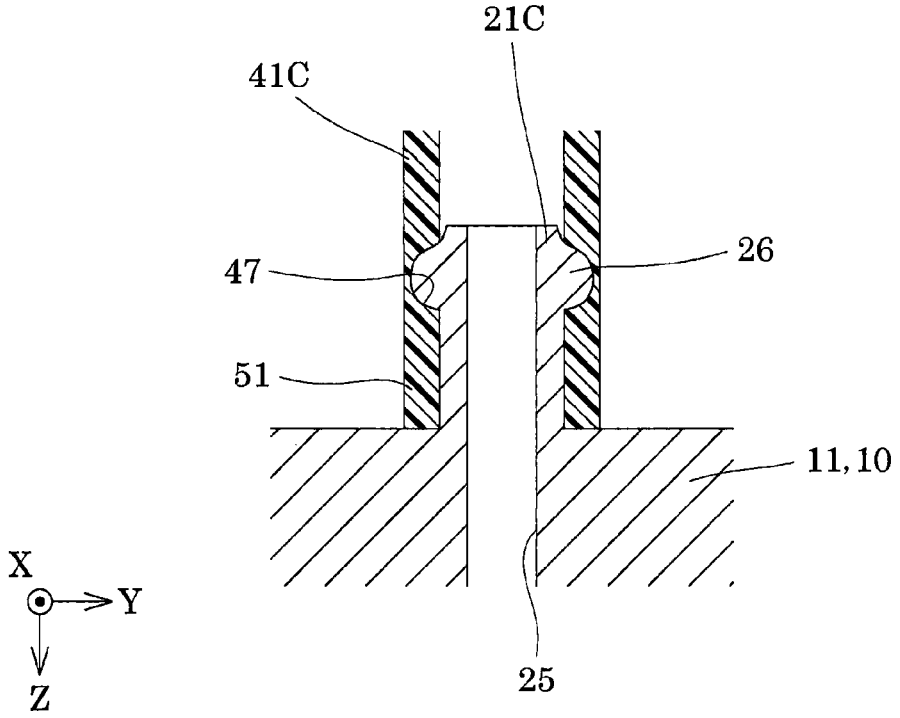
FIG. 14 is a cross-sectional view illustrating other examples of the first channel pipe and the first tube according to Embodiment 2.

FIG. 14 is a cross-sectional view illustrating a first channel pipe 21C and a first tube 41C according to another example of Embodiment 2. Note that elements similar to those described in Embodiment 1 will be denoted by the same reference symbols, and duplicated explanations will be omitted.

A protrusion 26 is formed on the outer peripheral surface of the first channel pipe 21C. The protrusion 26 protrudes in a direction perpendicular to the ±Z direction, in other words, perpendicular to the direction in which the first channel pipe 21C extends. In the present embodiment, the protrusion 26 is formed on the outer peripheral surface continuously around the first channel pipe 21C so as to protrude in a direction perpendicular to the ±Z direction. The shape of the protrusion 26 is not limited to this but may be a protrusion or multiple protrusions that separately protrude from the outer peripheral surface of the first channel pipe 21C in a direction perpendicular to the ±Z direction.

A groove 47 is formed in the inner peripheral surface of the first end portion 51 of the first tube 41C so as to be able to engage the protrusion 26. In the present embodiment, the groove 47 is formed annularly around the inner peripheral surface of the first end portion 51. The shape of the groove 47 is not limited to this but may be a groove or multiple grooves that are separately recessed from the inner peripheral surface of the first end portion 51 of the first tube 41C in a direction perpendicular to the ±Z direction so as to match the shape and the number of the protrusions 26.

Note that although not illustrated, the protrusion 26 is not formed at the second channel pipe and the groove 47 is not formed in the inner peripheral surface of the second end portion 52 of the first tube 41C. In other words, the shapes of the second channel pipe and the second end portion 52 remain similar to those described in Embodiment 1.

When the above first tube 41C is coupled to the above first channel pipe 21C and the second channel pipe 22 remaining similar to that in Embodiment 1, the groove 47 engages the protrusion 26. This causes the first fixation strength between the first tube 41C and the first channel pipe 21C to be greater than the second fixation strength between the first tube 41C and the second channel pipe 22.

As is the case for Embodiment 1, in the ink jet type recording apparatus 1 configured as described above, when the first head 11 needs to be replaced, the first head 11 can be detached from the channel member 30 with the first tube 41C being coupled securely to the first channel pipe 21C of the first head 11. Thus, the first tube 41C can be replaced simultaneously with the replacement of the first head 11, which can improve replacement performance of the first head 11. Moreover, when the first head 11 is detached from the channel member 30, the first tube 41C remains to be coupled to the first head 11, which reduces the likelihood of the residual ink spilling out of the first tube 41C.

Note that the protrusion 26 can be applied to the third channel pipe and the groove 47 can be applied to the second tube.

Figure 15:
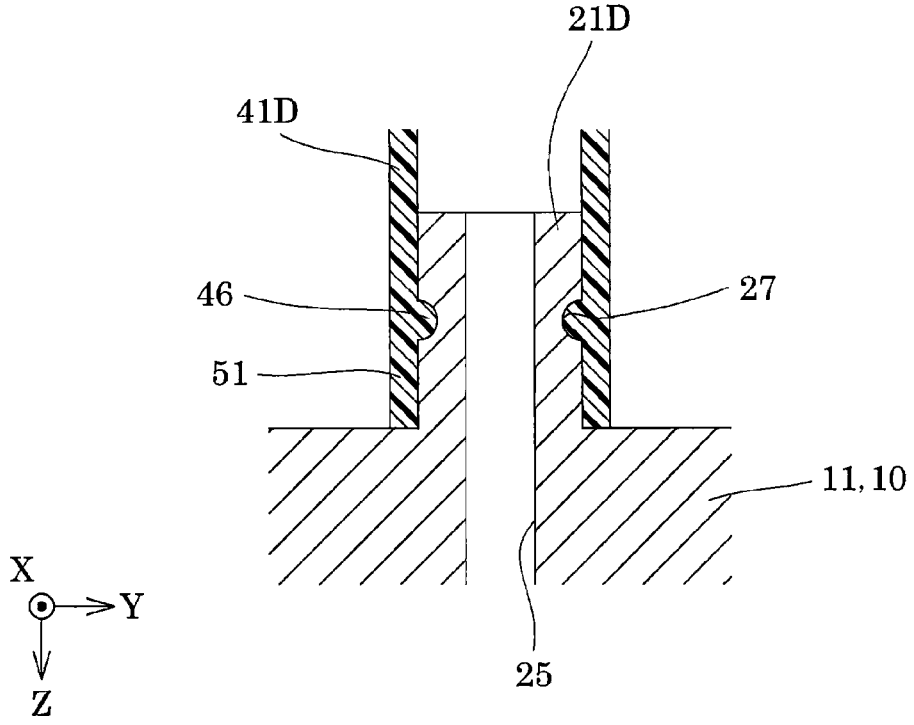
FIG. 15 is a cross-sectional view illustrating other examples of the first channel pipe and the first tube according to Embodiment 2.

FIG. 15 is a cross-sectional view illustrating a first channel pipe 21D and a first tube 41D according to another example of Embodiment 2. Note that elements similar to those described in Embodiment 1 will be denoted by the same reference symbols, and duplicated explanations will be omitted.

A groove 27 is formed on the outer peripheral surface of the first channel pipe 21D. The groove 27 is recessed in a direction perpendicular to the ±Z direction, in other words, perpendicular to the direction in which the first channel pipe 21D extends. In the present embodiment, the groove 27 is formed in the outer peripheral surface continuously around the first channel pipe 21D so as to be recessed in a direction perpendicular to the ±Z direction. The shape of the groove 27 is not limited to this but may be a groove or multiple grooves that are separately recessed from the outer peripheral surface of the first channel pipe 21D in a direction perpendicular to the ±Z direction.

A protrusion 46 is formed on the inner peripheral surface of the first end portion 51 of the first tube 41D so as to be able to engage the groove 27. In the present embodiment, the protrusion 46 is formed annularly around the inner peripheral surface of the first end portion 51. The shape of the protrusion 46 is not limited to this but may be a protrusion or multiple protrusions that separately protrude from the inner peripheral surface of the first end portion 51 of the first tube 41D in a direction perpendicular to the ±Z direction so as to match the shape and the number of the grooves 27.

Note that although not illustrated, the groove 27 is not formed at the second channel pipe and the protrusion 46 is not formed on the inner peripheral surface of the second end portion 52 of the first tube 41D. In other words, the shapes of the second channel pipe and the second end portion 52 remain similar to those described in Embodiment 1.

When the above first tube 41D is coupled to the above first channel pipe 21D and the second channel pipe 22 remaining similar to that in Embodiment 1, the protrusion 46 engages the groove 27. This causes the first fixation strength between the first tube 41D and the first channel pipe 21D to be greater than the second fixation strength between the first tube 41D and the second channel pipe 22.

As is the case for Embodiment 1, in the ink jet type recording apparatus 1 configured as described above, when the first head 11 needs to be replaced, the first head 11 can be detached from the channel member 30 with the first tube 41D being coupled securely to the first channel pipe 21D of the first head 11. Thus, the first tube 41D can be replaced simultaneously with the replacement of the first head 11, which can improve replacement performance of the first head 11. Moreover, when the first head 11 is detached from the channel member 30, the first tube 41D remains to be coupled to the first head 11, which reduces the likelihood of the residual ink spilling out of the first tube 41D.

Note that the groove 27 can be applied to the third channel pipe and the protrusion 46 can be applied to the second tube.

Figure 16:
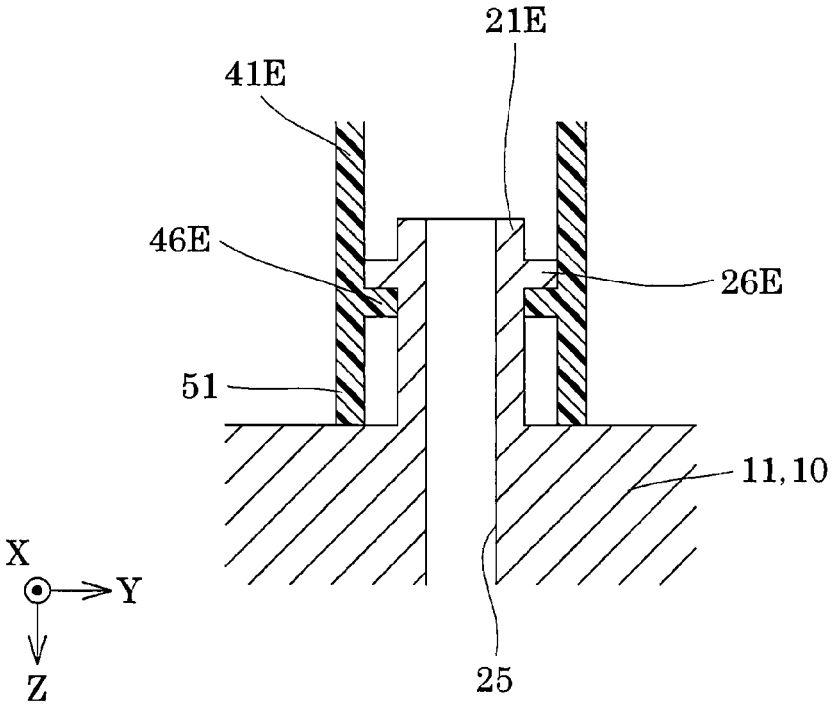
FIG. 16 is a cross-sectional view illustrating other examples of the first channel pipe and the first tube according to Embodiment 2.

FIG. 16 is a cross-sectional view illustrating a first channel pipe 21E and a first tube 41E according to another example of Embodiment 2. Note that elements similar to those described in Embodiment 1 will be denoted by the same reference symbols, and duplicated explanations will be omitted.

A protrusion 26E is formed on the outer peripheral surface of the first channel pipe 21E. The protrusion 26E protrudes in a direction perpendicular to the ±Z direction, in other words, perpendicular to the direction in which the first channel pipe 21E extends. In the present embodiment, the protrusion 26E is formed on the outer peripheral surface continuously around the first channel pipe 21E so as to protrude in a direction perpendicular to the ±Z direction. The shape of the protrusion 26E is not limited to this but may be a protrusion or multiple protrusions that separately protrude from the outer peripheral surface of the first channel pipe 21E in a direction perpendicular to the ±Z direction.

A protrusion 46E is formed on the inner peripheral surface of the first end portion 51 of the first tube 41E so as to be able to engage the protrusion 26E. In the present embodiment, the protrusion 46E is formed annularly around the inner peripheral surface of the first end portion 51. In addition, the protrusion 46E is positioned below the protrusion 26E in the ±Z direction. The shape of the protrusion 46E is not limited to this but may be a protrusion or multiple protrusions that separately protrude from the inner peripheral surface of the first end portion 51 of the first tube 41E in a direction perpendicular to the ±Z direction.

Note that although not illustrated, the above protrusion 26E is not formed at the second channel pipe and the protrusion 46E is not formed on the inner peripheral surface of the second end portion 52 of the first tube 41E. In other words, the shapes of the second channel pipe and the second end portion 52 remain similar to those described in Embodiment 1.

The above-described first tube 41E is coupled to the above first channel pipe 21E and the second channel pipe 22 remaining similar to that in Embodiment 1. More specifically, the first tube 41E is moved down with the first end portion 51 being expanded until the protrusion 46E comes below the protrusion 26E. The first tube 41E is fitted around the first channel pipe 21E, which causes the expanded first end portion 51 to return to the normal shape. Thus, the first tube 41E is coupled to the first channel pipe 21. If a force acts so as to detach the first tube 41E from the first channel pipe 21E, the first tube 41E does not come off the first channel pipe 21E easily due to the protrusion 46E engaging the protrusion 26E. This causes the first fixation strength between the first tube 41E and the first channel pipe 21E to be greater than the second fixation strength between the first tube 41E and the second channel pipe 22.

As is the case for Embodiment 1, in the ink jet type recording apparatus 1 configured as described above, when the first head 11 needs to be replaced, the first head 11 can be detached from the channel member 30 with the first tube 41E being coupled securely to the first channel pipe 21E of the first head 11. Thus, the first tube 41E can be replaced simultaneously with the replacement of the first head 11, which can improve replacement performance of the first head 11. Moreover, when the first head 11 is detached from the channel member 30, the first tube 41E remains to be coupled to the first head 11, which reduces the likelihood of the residual ink spilling out of the first tube 41E.

Note that the protrusion 26E can be applied to the third channel pipe and the protrusion 46E can be applied to the second tube.

Figure 17:
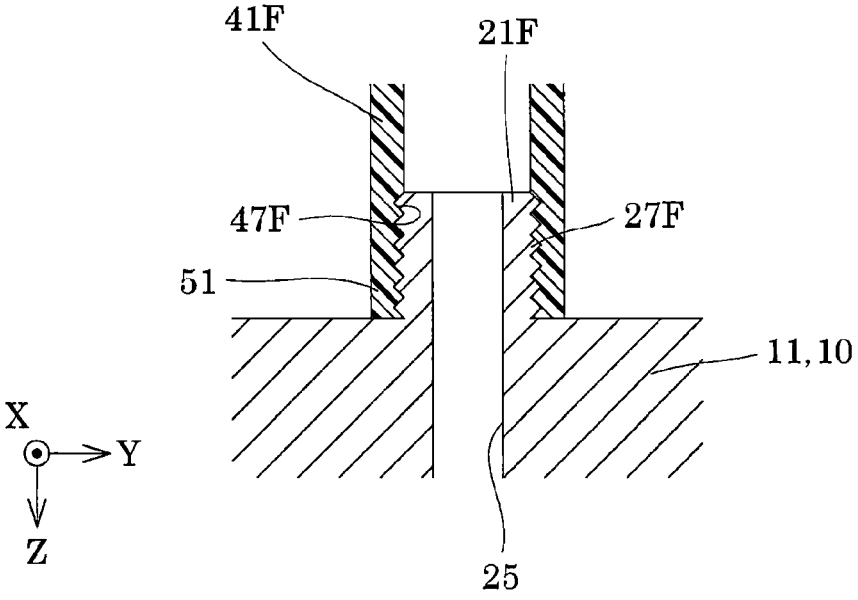
FIG. 17 is a cross-sectional view illustrating other examples of the first channel pipe and the first tube according to Embodiment 2.

FIG. 17 is a cross-sectional view illustrating a first channel pipe 21F and a first tube 41F according to another example of Embodiment 2. Note that elements similar to those described in Embodiment 1 will be denoted by the same reference symbols, and duplicated explanations will be omitted.

Multiple grooves 27F are formed on the outer peripheral surface of the first channel pipe 21F. The grooves 27F are recessed in a direction perpendicular to the ±Z direction, in other words, perpendicular to the direction in which the first channel pipe 21F extends. In the present embodiment, the grooves 27F are formed in the outer peripheral surface continuously around the first channel pipe 21F so as to be recessed in a direction perpendicular to the ±Z direction. The multiple grooves 27F are arranged side by side in the ±Z direction.

Multiple grooves 47F are formed in the inner peripheral surface of the first end portion 51 of the first tube 41F so as to be able to engage the grooves 27F. In the present embodiment, the grooves 47F are formed annularly around the inner peripheral surface of the first end portion 51. Such multiple grooves 47F are arranged side by side in the ±Z direction.

Note that although not illustrated, the grooves 27F are not formed at the second channel pipe and the grooves 47F are not formed in the inner peripheral surface of the second end portion 52 of the first tube 41F. In other words, the shapes of the second channel pipe and the second end portion 52 remain similar to those described in Embodiment 1.

The above-described first tube 41F is coupled to the above first channel pipe 21F and the second channel pipe 22 remaining similar to that in Embodiment 1. When the first tube 41F is coupled to the first channel pipe 21, the grooves 47F engage the grooves 27F. This causes the first fixation strength between the first tube 41F and the first channel pipe 21F to be greater than the second fixation strength between the first tube 41F and the second channel pipe 22.

As is the case for Embodiment 1, in the ink jet type recording apparatus 1 configured as described above, when the first head 11 needs to be replaced, the first head 11 can be detached from the channel member 30 with the first tube 41F being coupled securely to the first channel pipe 21F of the first head 11. Thus, the first tube 41F can be replaced simultaneously with the replacement of the first head 11, which can improve replacement performance of the first head 11. Moreover, when the first head 11 is detached from the channel member 30, the first tube 41F remains to be coupled to the first head 11, which reduces the likelihood of the residual ink spilling out of the first tube 41F.

Note that the grooves 27F can be applied to the third channel pipe and the grooves 47F can be applied to the second tube.

The ink jet type recording apparatus 1 may have a configuration obtained by combining the configurations illustrated in FIGS. 12 and 13. The following describes a configuration obtained by combinedly using the first channel pipe 21A and the second channel pipe 22A of FIG. 12 and the first tube 41B of FIG. 13.

The inside diameter W3 of the first end portion 51 of the first tube 41B is smaller than the outside diameter W1 of the first channel pipe 21A, and the inside diameter W4 of the second end portion 52 of the first tube 41B is smaller than the outside diameter W2 of the second channel pipe 22A. The first end portion 51 of the first tube 41B is coupled to the first channel pipe 21A, and the second end portion 52 is coupled to the second channel pipe 22A.

With this configuration, the first fixation strength between the first tube 41B and the first channel pipe 21A is caused to be greater than the second fixation strength between the first tube 41B and the second channel pipe 22A. Note that the above combination of the configurations of FIGS. 12 and 13 can be applied to the third channel pipe and the second tube.

In addition, the ink jet type recording apparatus 1 may have a configuration obtained by combining two or more configurations illustrated in FIGS. 14 to 17 in order to improve the first fixation strength between the first channel pipe and the first tube.

For example, the first tube 41 of Embodiment 1 or the first tube 41B of Embodiment 2 illustrated in FIG. 13 may have two or more of the protrusions and grooves selected from a group including the groove 47 of FIG. 14, the protrusion 46 of FIG. 15, protrusion 46E of FIG. 16, and the grooves 47F of FIG. 17. The selected protrusions and grooves may be disposed at different positions in the ±Z direction. Similarly, the first channel pipe 21 of Embodiment 1 or the first channel pipe 21A of Embodiment 2 illustrated in FIG. 12 may have two or more of the protrusions and grooves selected from a group including the protrusion 26 of FIG. 14, the groove 27 of FIG. 15, the protrusion 26E of FIG. 16, and the grooves 27F of FIG. 17. The selected protrusions and grooves may be disposed at different positions in the ±Z direction on the first channel pipe 21 or the first channel pipe 21A so as to match the selected protrusions and the grooves disposed in the first tube 41 or the first tube 41B.

By combinedly using the protrusions and the grooves that are illustrated in FIGS. 14 to 17, the first fixation strength between the first tube 41 or the first tube 41B and the first channel pipe 21 or the first channel pipe 21A can be caused to be even greater than the second fixation strength between the first tube 41 or the first tube 41B and the second channel pipe 22. Note that the above-described combination of the configurations of FIGS. 14 to 17 may be applied to the third channel pipe and the second tube.

Embodiment 3

Figure 18:
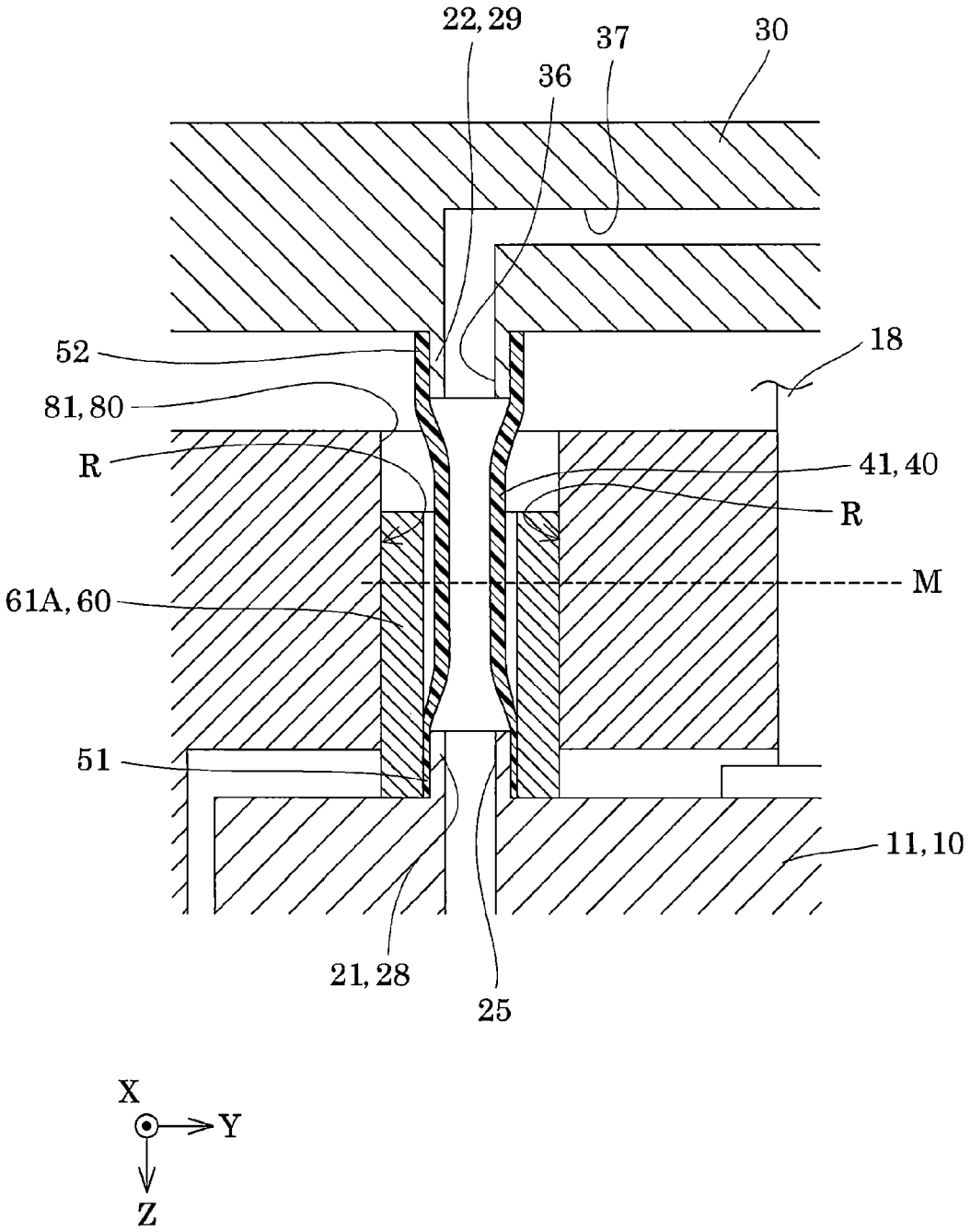
FIG. 18 is a cross section of a support member according to Embodiment 3, which is taken along a first side surface.

FIG. 18 is a cross-sectional view of the support member 70, which is taken along the first side surface 71, in other words, taken along line XVIII-XVIII in FIG. 3. Note that elements similar to those described in Embodiment 1 will be denoted by the same reference symbols, and duplicated explanations will be omitted.

As illustrated in FIG. 18, the center of the first tube 41 in the ±Z direction is denoted by reference M. A first fixation member 61A has a portion that is positioned closer than the center M of the first tube 41 to the channel member 30 in the ±Z direction. In other words, the portion of the first fixation member 61A is positioned in the −Z direction from the center M of the first tube 41. This first fixation member 61A is in contact with the first guide groove 81. The contact region R of the first guide groove 81 with which the first fixation member 61A comes into contact is positioned closer than the center M to the channel member 30.

Put another way, the first guide groove 81 guides the first fixation member 61A at a position close to the second channel pipe 22. This prevents the first tube 41, which is guided by the first fixation member 61A, from deviating largely from the second channel pipe 22. Accordingly, in the ink jet type recording apparatus 1 of the present embodiment, the first guide groove 81, which guides the first tube 41 indirectly with the first fixation member 61A interposed therebetween, can position the first tube 41 accurately with respect to the second channel pipe 22.

Embodiment 4

Figure 19:
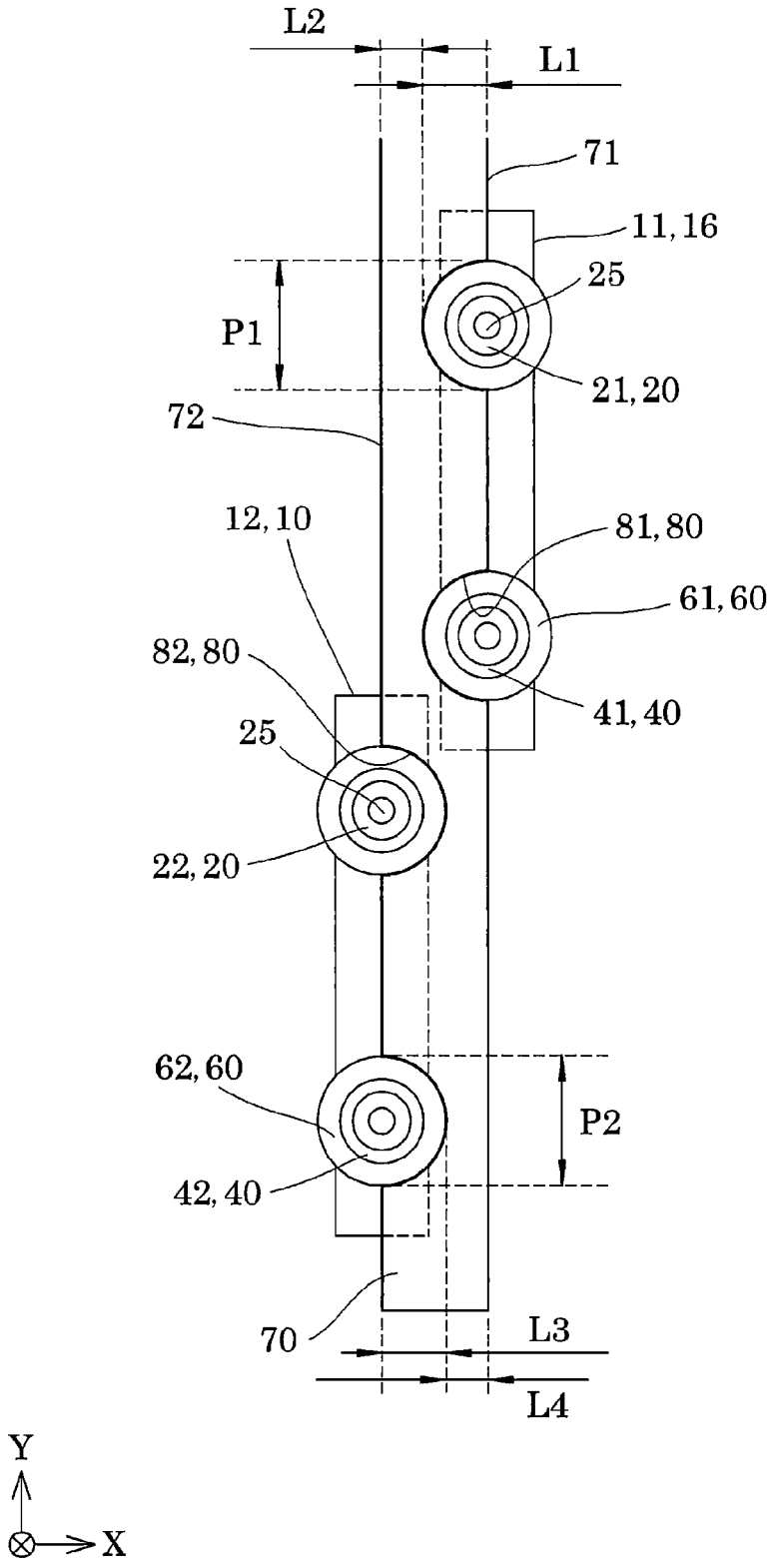
FIG. 19 is a plan view illustrating part of an ink jet type recording apparatus according to Embodiment 4.

FIG. 19 is a plan view illustrating part of the ink jet type recording apparatus 1 according to Embodiment 4. Note that elements similar to those described in Embodiment 1 will be denoted by the same reference symbols, and duplicated explanations will be omitted.

The outer peripheral surface of the first fixation member 61 protrudes in the ±X direction beyond the outer surface of the first head 11. The outer peripheral surface of the second fixation member 62 protrudes in the ±X direction beyond the outer surface of the second head 12.

The support member 70 has a portion P1 at which a first guide groove 81 is formed. In the portion P1, a maximum length L1 in the ±X direction between the first side surface 71 and the surface of the first guide groove 81 is greater than a minimum dimension L2 of the support member 70 in the ±X direction. Here, the maximum length L1 is a maximum depth of the first guide groove 81. The minimum dimension L2 is the thickness, in the ±X direction, of the thinnest portion of the support member 70 in the portion P1 at which the first guide groove 81 is formed.

Similarly, the support member 70 has a portion P2 at which a second guide groove 82 is formed. In the portion P2, a maximum length L3 in the ±X direction between the second side surface 72 and the surface of the second guide groove 82 is greater than a minimum dimension L4 of the support member 70 in the ±X direction. The maximum length L3 here is a maximum depth of the second guide groove 82. The minimum dimension L4 is the thickness, in the ±X direction, of the thinnest portion of the support member 70 in the portion P2 at which the second guide groove 82 is formed.

As is the case for Embodiment 1, in the ink jet type recording apparatus 1 of the present embodiment, the first guide grooves 81 are positioned differently from the second guide grooves 82 in the ±Y direction. Accordingly, it is not necessary to increase the width of the support member 70 in the ±X direction to obtain the thickness between the first guide groove 81 and the second guide groove 82. In other words, according to the present embodiment, the size of the ink jet type recording apparatus 1 can be reduced in the ±X direction without sacrificing the rigidity of the support member 70.

Moreover, in the ink jet type recording apparatus 1 according to the present embodiment, the first fixation member 61 protrudes beyond the outer surface of the first head 11, and the second fixation member 62 protrudes beyond the outer surface of the second head 12. This makes it possible to increase the size of the first fixation member 61 and the second fixation member 62. Accordingly, this can increase the size of the first tube 41 and the second tube 42, which are fixed using the first fixation member 61 and the second fixation member 62. An increase in the size of the first tube 41 and the second tube 42 leads to an increase in the flow rate of ink.

Embodiment 5

Figure 20:
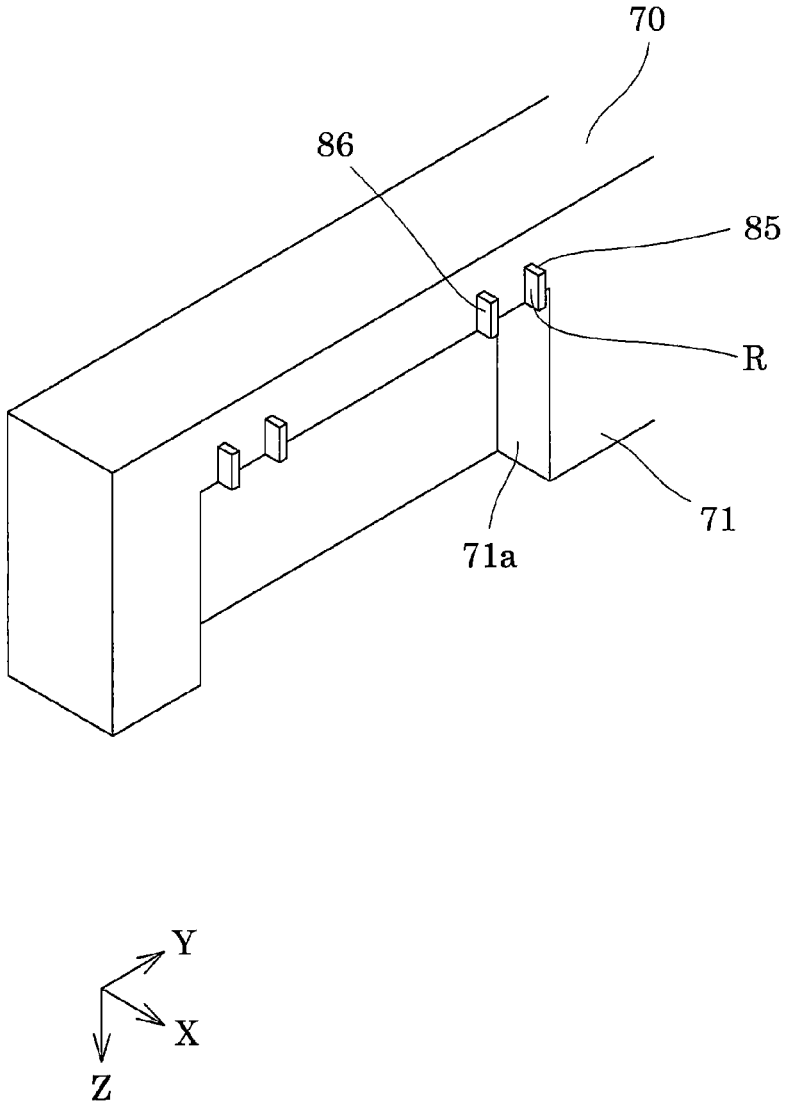
FIG. 20 is a perspective view illustrating part of an ink jet type recording apparatus according to Embodiment 5.
Figure 21:
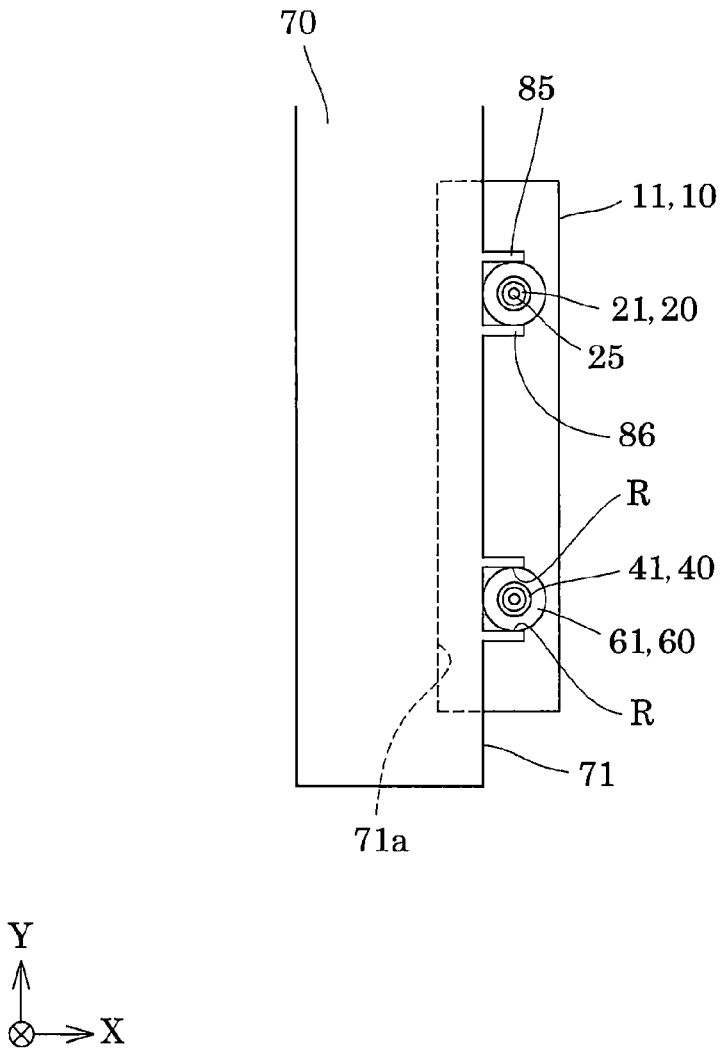
FIG. 21 is a plan view illustrating part of the ink jet type recording apparatus according to Embodiment 5.
Figure 22:
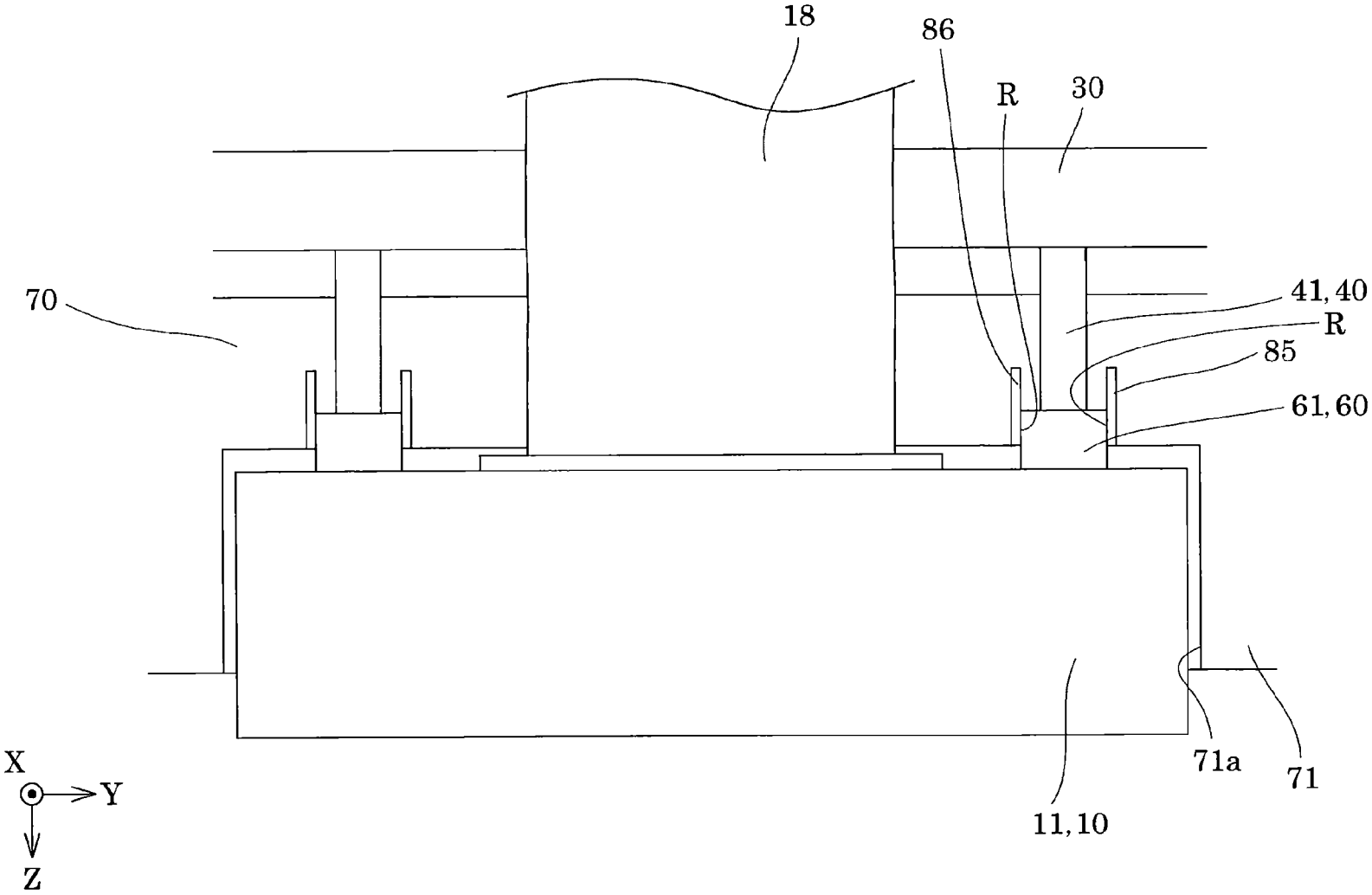
FIG. 22 is a side view illustrating part of the ink jet type recording apparatus according to Embodiment 5.

FIGS. 20 to 22 illustrate part of an ink jet type recording apparatus 1 according to Embodiment 5. FIG. 20 is a perspective view, FIG. 21 is a plan view, and FIG. 22 is a side view. Note that elements similar to those described in Embodiment 1 will be denoted by the same reference symbols, and duplicated explanations will be omitted.

The support member 70 includes first guide protrusions 85 and second guide protrusions 86, which are examples of the guide portions. The first and second guide protrusions 85 and 86 are formed on the first side surface 71 of the support member 70 so as to protrude in the +X direction from the first side surface 71. The first and second guide protrusions 85 and 86 are formed like cuboids and face each other in the ±Y direction. Two pairs of the first and second guide protrusions 85 and 86 are disposed per each first head 11.

The side surface of each first guide protrusion 85 that faces the second guide protrusion 86 serves as the contact region R, and the side surface of the second guide protrusion 86 that faces the first guide protrusion 85 also serves as the contact region R. The distance in the ±Y direction between the paired first and second guide protrusions 85 and 86, in other words, the distance between respective contact regions R, is set to be substantially equal to the diameter of the first fixation member 61. In other words, when the first fixation member 61 is placed between the first and second guide protrusions 85 and 86, the first fixation member 61 comes into contact with the contact regions R of the first and second guide protrusions 85 and 86.

The first and second guide protrusions 85 and 86 guide the first tube 41 while the contact regions R are in contact with the outer peripheral surface of the first fixation member 61. In other words, the second end portion 52 of the first tube 41 is caused to come under the second channel pipe 22 in the ±Z direction in the state in which the first fixation member 61 that fixes the first tube 41 is in contact with the contact regions R.

In other words, in the state of the first and second guide protrusions 85 and 86 guiding the first tube 41 via the first fixation member 61, the first tube 41 can be coupled to the second channel pipe 22 by moving the first head 11 in the −Z direction toward the second channel pipe 22. This can reduce the amount of positional adjustment of the first tube 41 in the ±X direction and in the ±Y direction. The first tube 41 can be thereby coupled smoothly to the second channel pipe 22.

The first tube 41 is guided indirectly by the first and second guide protrusions 85 and 86 with the first fixation member 61 interposed therebetween. This indirect guidance can prevent the first tube 41 from being in contact, or in frequent contact, with the first and second guide protrusions 85 and 86, which can reduce the wear of the first tube 41.

In the present embodiment, the method of fixing the first head 11 to the support member 70 of the ink jet type recording apparatus 1 is not specifically described nor illustrated. The first head 11, however, can be fixed to the support member 70 using the method described in Embodiment 1. In other words, as described in Embodiment 1, the mounting portions 90 are disposed at each first head 11, and the positioning hole 95 and the fixation screw insertion hole 96 are formed in each mounting portion 90. The corresponding positioning pin 75 and fixation screw hole 76 are formed at the support member 70. The fixation screw 97 is screwed into the fixation screw hole 76 through the fixation screw insertion hole 96 in the state of the positioning pin 75 being inserted in the positioning hole 95. Thus, the ink jet type recording apparatus 1 according to the present embodiment enables the first head 11 to be detached from the support member 70 for replacement as is the case for Embodiment 1.

Other Embodiments

Embodiments of the present disclosure have been described. The present disclosure, however, is not limited to those described above. In the above embodiments, the ink jet type recording apparatus 1 is described as having the first heads 11 and the second heads 12. The ink jet type recording apparatus 1, however, is not limited to this configuration. For example, the ink jet type recording apparatus 1 may include only first heads 11. In other words, the heads 10 are disposed only on the first side surface 71 of the support member 70. The ink jet type recording apparatus 1 is described as having three first heads 11 and three second heads 12. The number of heads, however, is not specifically limited.

The first fixation member 61 of the above embodiments is described as being shaped annularly so as to cover the entire outer peripheral surface of the first end portion 51 of the first tube 41 coupled to the first channel pipe 21. The first fixation member 61, however, is not limited to such a shape. The first fixation member 61 may be shaped so as to cover at least part of the first end portion 51. In addition, the first fixation member, which fastens the first end portion 51 tightly from outside, may be a binding member configured to be wound around the outer peripheral surface of the first end portion 51 of the first tube 41 coupled to the first channel pipe 21. The fixation strength is derived from a force of the binding member to fasten the first tube 41 around the first channel pipe 21.

The first fixation member 61 may be formed of a member that can shrink by heat. In this case, the inside diameter of the first fixation member 61 may be larger than the outside diameter of the first end portion 51 of the first tube 41 coupled to the first channel pipe 21. The first fixation member 61 shrinks by heat and the inside diameter is decreased, which can fasten the first end portion 51 tightly from outside.

FIG. 12 illustrates the first channel pipe 21A and the second channel pipe 22A with a smaller diameter than that of the first channel pipe 21A, and FIG. 13 illustrates the first tube 41B in which the inside diameter of the first end portion 51 is smaller than the inside diameter of the second end portion 52. The first tube 41B of FIG. 13 may be coupled to the first channel pipe 21A and the second channel pipe 22A of FIG. 12. This causes the first fixation strength to be even greater than the second fixation strength.

In the above embodiments, the hardness of the first fixation member 61 is set to be higher than that of the first tube 41, and the hardness of the first guide groove 81 is set to be higher than that of the first tube 41. The hardness relationship, however, is not limited to this. Moreover, in the above embodiments, the hardness of the first fixation member 61 is set to be lower than the hardness of the first guide groove 81, but the hardness relationship is not limited to this.

In the above embodiments, the hardness of the second fixation member 62 is set to be higher than that of the second tube 42, and the hardness of the second guide groove 82 is set to be higher than that of the second tube 42, but the hardness relationship is not limited to this. Moreover, in the above embodiments, the hardness of the second fixation member 62 is set to be lower than the hardness of the second guide groove 82, but the hardness relationship is not limited to this.

In the above embodiments, the ink jet type recording apparatus 1 is configured to include the support member 70, but the ink jet type recording apparatus 1 is not limited to this configuration. For example, the channel member 30 may have a function to hold the heads 10. In other words, the channel member 30 and the support member 70 may be formed integrally into one member.

In the above embodiments, the first guide grooves 81, the second guide grooves 82, the first and second guide protrusions 85 and 86, all of which are examples of the guide portion, are formed in the support member 70. However, the guide portion is not limited to such a configuration. The guide portion may be formed in another member instead of being formed in the support member 70.

In the above embodiments, the first channel pipe 21 and the second channel pipe 22 are formed so as to protrude in the ±Z direction. The first channel pipe 21 and the second channel pipe 22 are not limited to such configurations. For example, the first channel pipe 21 and the second channel pipe 22 may protrude in a direction other than ±Z direction. In addition, in the above embodiments, the first tube 41 is formed so as to extend substantially straight in the ±Z direction to couple the first channel pipe 21 to the second channel pipe 22. The second tube 42 is formed similarly to couple the third channel pipe 23 to the fourth channel pipe 24. The first tube 41 and the second tube 42, however, are not limited to such configurations. For example, the first tube 41 and the second tube 42 may be bent to couple corresponding channel pipes to each other. The tips of the first channel pipe 21 and the second channel pipe 22 may be shaped like needles.

In the above embodiments, the length of the first tube 41 is set to be shorter than the dimension of the first head 11 in the ±Z direction, and the length of the second tube 42 is set to be shorter than the dimension of the second head 12 in the ±Z direction. However, the lengths of the first tube 41 and the second tube 42 are not specifically limited.

The present disclosure is directed to liquid ejecting heads in general. For example, the present disclosure may be applied to recording heads, such as various types of ink jet type recording heads used in image recording apparatuses, such as printers, and also applied to color material ejecting heads used in manufacturing color filters for liquid crystal displays, etc. Moreover, the present disclosure may be applied to electrode material ejecting heads used in forming electrodes for organic EL displays, field emission displays (FED), etc., and also applied to living organic material ejecting heads used in manufacturing biochips. Note that the type of a liquid ejecting apparatus in which such a liquid ejecting head is mounted is not specifically limited.

What is claimed is:

1. A liquid ejecting apparatus comprising:

a first liquid ejecting head that configures to eject a liquid in a first direction and that has a first channel pipe through which the liquid flows;

a channel member having a second channel pipe through which the liquid flows; and a first tube communicating the first channel pipe with the second channel pipe and having flexibility, wherein the first tube has a first end portion and a second end portion that is opposite to the first end portion, the first tube is coupled to the first channel pipe in such a manner that the first end portion covers an outer periphery of the first channel pipe, the first tube is coupled to the second channel pipe in such a manner that the second end portion covers an outer periphery of the second channel pipe, and a fixation strength between the first tube and the first channel pipe is greater than a fixation strength between the first tube and the second channel pipe.

2. The liquid ejecting apparatus according to claim 1, further comprising:

a first fixation member fixing the first tube to the first channel pipe by tightening the first end portion from outside.

3. The liquid ejecting apparatus according to claim 2, further comprising:

a guide portion that has a contact region to be in contact with an outer peripheral surface of the first fixation member and that is configured to guide the first tube by contacting the contact region with the outer peripheral surface of the first fixation member, wherein a hardness of the first fixation member is higher than that of the first tube, and a hardness of the guide portion is higher than that of the first tube.

4. The liquid ejecting apparatus according to claim 3, wherein at least a part of the contact region is closer to the channel member than to a longitudinal center of the first tube.

5. The liquid ejecting apparatus according to claim 3, wherein a hardness of the first fixation member is lower than that of the guide portion.

6. The liquid ejecting apparatus according to claim 3, further comprising:

a support member that holds the first liquid ejecting head, wherein the guide portion is a first guide groove formed at the support member.

7. The liquid ejecting apparatus according to claim 1, wherein a maximum outside diameter of the first channel pipe is greater than a maximum outside diameter of the second channel pipe.

8. The liquid ejecting apparatus according to claim 1, wherein an inside diameter of the first end portion is smaller than an inside diameter of the second end portion.

9. The liquid ejecting apparatus according to claim 1, wherein a groove or a protrusion is formed on an outer peripheral surface of the first channel pipe so as to extend in a direction perpendicular to a direction in which the first channel pipe extends, and a protrusion configured to engage the groove of the first channel pipe or a groove configured to engage the protrusion of the first channel pipe is formed on an inner peripheral surface of the first end portion.

10. The liquid ejecting apparatus according to claim 1, the liquid ejecting apparatus further comprising:

a second liquid ejecting head that configures to eject the liquid in the first direction and that has a third channel pipe through which the liquid flows; and a second tube that has a third end portion and a fourth end portion that is opposite to the third end portion and that has flexibility, wherein the channel member has a fourth channel pipe through which the liquid flows, the second tube communicates the third channel pipe with the fourth channel pipe, the second tube is coupled to the third channel pipe in such a manner that the third end portion covers an outer periphery of the third channel pipe, the second tube is coupled to the fourth channel pipe in such a manner that the fourth end portion covers an outer periphery of the fourth channel pipe, and a fixation strength between the second tube and the third channel pipe is greater than a fixation strength between the second tube and the fourth channel pipe.

11. The liquid ejecting apparatus according to claim 1, further comprising:

a first fixation member fixing the first tube and the first channel pipe by tightening the first end portion from outside;

a second liquid ejecting head that configures to eject the liquid in the first direction and that has a third channel pipe through which the liquid flows;

a second tube that has a third end portion and a fourth end portion that is opposite to the third end portion and that has flexibility;

a second fixation member fixing the second tube to the third channel pipe by tightening the third end portion from outside;

a support member that holds the first liquid ejecting head and the second liquid ejecting head;

a first guide groove that is formed at the support member, that has a contact region to be in contact with an outer peripheral surface of the first fixation member, and that is configured to guide the first tube by contacting the contact region with the outer peripheral surface of the first fixation member; and a second guide groove that is formed at the support member and that is configured to guide the second tube by contacting with the outer peripheral surface of the second fixation member, wherein a hardness of the first fixation member is higher than that of the first tube, a hardness of the first guide groove is higher than that of the first tube, the channel member has a fourth channel pipe through which the liquid flows, the second tube communicates the third channel pipe with the fourth channel pipe, the second tube is coupled to the third channel pipe in such a manner that the third end portion covers an outer periphery of the third channel pipe, the second tube is coupled to the fourth channel pipe in such a manner that the fourth end portion covers an outer periphery of the fourth channel pipe, a fixation strength between the second tube and the third channel pipe is greater than a fixation strength between the second tube and the fourth channel pipe, a hardness of the second guide groove is higher than that of the second tube, a hardness of the second fixation member is higher than that of the second tube, as viewed in the first direction, the support member extends longitudinally in a second direction that is a direction perpendicular to the first direction and extends laterally in a third direction that is a direction perpendicular to the first direction and the second direction, at least a portion of the first liquid ejecting head overlaps the second liquid ejecting head as viewed in the third direction, the first guide groove is formed at a first side surface of the support member that faces in the third direction, the second guide groove is formed at a second side surface of the support member that is opposite from the first side surface, and the first guide groove and the second guide groove are positioned differently in the second direction.

12. The liquid ejecting apparatus according to claim 11, wherein the outer peripheral surface of the first fixation member protrudes beyond an outer surface of the first liquid ejecting head in the third direction, the outer peripheral surface of the second fixation member protrudes beyond an outer surface of the second liquid ejecting head in the third direction, in a portion of the support member in which the first guide groove is formed, a maximum length in the third direction between the first side surface and a surface of the first guide groove is greater than a minimum dimension of the support member in the third direction, and in a portion of the support member in which the second guide groove is formed, a maximum length in the third direction between the second side surface and a surface of the second guide groove is greater than a minimum dimension of the support member in the third direction.

13. The liquid ejecting apparatus according to claim 11, wherein a portion of the first liquid ejecting head overlaps a portion of the second liquid ejecting head as viewed in the third direction, and the first guide groove does not overlap the second guide groove as viewed in the third direction.

14. The liquid ejecting apparatus according to claim 1, wherein the first liquid ejecting head is positioned in the first direction with respect to the channel member, the first channel pipe protrudes from the first liquid ejecting head in a direction opposite to the first direction, the second channel pipe protrudes from the channel member in the first direction, and the first tube is coupled to the first channel pipe and the second channel pipe in such a manner that the first tube extends substantially straight in the first direction.

15. The liquid ejecting apparatus according to claim 1, wherein a length of the first tube is smaller than a dimension of the first liquid ejecting head in the first direction.

16. The liquid ejecting apparatus according to claim 1, wherein the first tube is formed of a member having such characteristics that with respect to a horizontal surface, the second end portion of the first tube opens on a side opposite to the gravity direction when the first end portion of the first tube is coupled to the first channel pipe and the second end portion is not coupled to the second channel pipe in a state of the first channel pipe protruding in a direction opposite to the gravity direction.

* * * * *